US012259179B2

(12) United States Patent
Park et al.

(10) Patent No.: US 12,259,179 B2
(45) **Date of Patent: *Mar. 25, 2025**

(54) REFRIGERATOR

(71) Applicant: Samsung Electronics Co., Ltd., Suwon-si (KR)

(72) Inventors: Sungdeuk Park, Suwon-si (KR); Youngmin Kwon, Suwon-si (KR); Jeongman Nam, Suwon-si (KR); Seongwoo Kim, Suwon-si (KR); Seungho Yoon, Suwon-si (KR); Hojun Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/437,957

(22) Filed: Feb. 9, 2024

(65) Prior Publication Data

US 2024/0219105 A1 Jul. 4, 2024

Related U.S. Application Data

(63) Continuation of application No. 17/869,089, filed on Jul. 20, 2022, now Pat. No. 11,940,203, which is a (Continued)

(30) Foreign Application Priority Data

Apr. 8, 2020 (KR) ..... 10-2020-0043017
Nov. 16, 2020 (KR) ..... 10-2020-0152722

(51) Int. Cl.
*F25D 23/02* (2006.01)
*A47B 96/20* (2006.01)
*A47L 15/42* (2006.01)

(52) U.S. Cl.
CPC ..... *F25D 23/028* (2013.01); *A47B 96/201* (2013.01); *A47B 2096/208* (2013.01); (Continued)

(58) Field of Classification Search
CPC ..... F25D 23/028; F25D 2201/10; F25D 2323/021; F25D 23/02; F25D 2400/18; (Continued)

(56) References Cited

U.S. PATENT DOCUMENTS 3,790,243 A 2/1974 Whorton, III
4,087,143 A 5/1978 Barnard
(Continued)

FOREIGN PATENT DOCUMENTS

CA 2 536 420 A1 8/2007
CN 2 186 311 A 8/1987
(Continued)

OTHER PUBLICATIONS

Office Action dated May 14, 2024, issued in Brazilian Patent Application No. BR 11 2022 014957-3.
(Continued)

*Primary Examiner* — Hanh V Tran
(74) *Attorney, Agent, or Firm* — STAAS & HALSEY LLP

(57) ABSTRACT

Provided is a refrigerator including a main body including a storeroom, a door body arranged to open or close the storeroom, a decoration panel coupled to a front side of the door body, and a holder mounted on the front side of the door body to be coupled to the decoration panel. The door body includes a rear case defining a rear side of the door body, and a main case defining front and sides of the door body. The main case includes a front part defining the front side of the door body and having an installation groove in which to install the holder, side parts defining sides of the (Continued)

door body, and a rear coupler coupled to the rear case. The main case is formed by bending a single metal board.

6 Claims, 20 Drawing Sheets

Related U.S. Application Data continuation of application No. 17/673,439, filed on Feb. 16, 2022, now Pat. No. 11,428,457, which is a continuation of application No. 17/185,384, filed on Feb. 25, 2021, now Pat. No. 11,280,542, which is a continuation of application No. 16/950,773, filed on Nov. 17, 2020, now Pat. No. 11,280,540.

(52) U.S. Cl.
CPC ..... *A47L 15/4265* (2013.01); *F25D 2323/02* (2013.01); *F25D 2323/021* (2013.01); *F25D 2400/18* (2013.01)

(58) Field of Classification Search
CPC ..... A47L 15/4265; A47B 96/201; A47B 2096/208
See application file for complete search history.

(56) References Cited

U.S. PATENT DOCUMENTS

| | | | |
|---|---|---|---|
| 4,583,796 | A | 4/1986 | Nakajima et al. |
| 4,765,697 | A | 8/1988 | Gardell |
| 5,358,326 | A | 10/1994 | Cherry et al. |
| 6,722,083 | B2 | 4/2004 | Herrmann |
| 6,779,859 | B2 | 8/2004 | Koons |
| 6,840,773 | B2 | 1/2005 | Anderson |
| 7,516,531 | B2 | 4/2009 | Crompton et al. |
| 7,673,472 | B2 | 3/2010 | Kwon |
| 8,020,949 | B2 | 9/2011 | Davis et al. |
| 8,104,853 | B2 | 1/2012 | Kim |
| 8,226,178 | B2 | 7/2012 | Kümmel |
| 8,336,974 | B2 | 12/2012 | Lee |
| 8,336,975 | B2 | 12/2012 | Allard |
| 8,353,564 | B2 | 1/2013 | Kim |
| 8,366,221 | B2 | 2/2013 | Kim |
| 8,408,665 | B2 | 4/2013 | Lim |
| 8,567,885 | B2 | 10/2013 | Lee |
| 8,668,292 | B2 | 3/2014 | Pae |
| 8,789,900 | B2 | 3/2014 | Laible |
| 9,185,981 | B1 | 11/2015 | Kane |
| 9,279,609 | B2 | 3/2016 | Kim |
| 9,339,993 | B2 | 5/2016 | Cites |
| 9,448,005 | B2 | 9/2016 | Lee et al. |
| 9,476,633 | B2 | 10/2016 | Allard |
| 9,500,402 | B2 | 11/2016 | Kim |
| 9,528,748 | B2 | 12/2016 | Joo |
| 9,671,152 | B2 | 6/2017 | Kim et al. |
| 9,702,621 | B2 | 7/2017 | Cho et al. |
| 9,810,475 | B2 | 11/2017 | Kim |
| 9,890,990 | B2 | 2/2018 | Allard |
| 10,145,603 | B2 | 12/2018 | Kim et al. |
| 10,317,128 | B2 | 6/2019 | Son et al. |
| 10,670,320 | B2 | 6/2020 | Lee et al. |
| 11,320,192 | B2 | 5/2022 | Lee |
| 11,402,147 | B2 | 8/2022 | Lee et al. |
| 2004/0194253 | A1 | 10/2004 | Jung |
| 2004/0222725 | A1 | 11/2004 | Park et al. |
| 2005/0006997 | A1 | 1/2005 | Yoshioka |
| 2006/0152125 | A1 | 7/2006 | Anderson et al. |
| 2006/0265960 | A1 | 11/2006 | Leimkuehler |
| 2007/0188059 | A1 | 8/2007 | Davis et al. |
| 2008/0042537 | A1 | 2/2008 | Kim |
| 2008/0143227 | A1 | 6/2008 | Kim et al. |
| 2009/0045705 | A1 | 2/2009 | Laible et al. |
| 2010/0295425 | A1 | 11/2010 | Kim |
| 2011/0025173 | A1 | 2/2011 | Ciyanogku |
| 2012/0073202 | A1 | 3/2012 | Lee |
| 2012/0169196 | A1 | 7/2012 | Marchetti |
| 2012/0280608 | A1 | 11/2012 | Park et al. |
| 2013/0323461 | A1 | 12/2013 | Shim |
| 2014/0132146 | A1 | 5/2014 | Kim et al. |
| 2015/0115782 | A1 | 4/2015 | Resch |
| 2015/0145399 | A1 | 5/2015 | Joo |
| 2015/0159936 | A1 | 6/2015 | Oh et al. |
| 2015/0192353 | A1 | 7/2015 | Lee |
| 2016/0061511 | A1 | 3/2016 | Park |
| 2016/0117022 | A1 | 4/2016 | Kim |
| 2016/0209110 | A1 | 7/2016 | Cho |
| 2016/0305706 | A1 | 10/2016 | Lim |
| 2016/0334158 | A1 | 11/2016 | Joo |
| 2016/0341468 | A1 | 11/2016 | Joo |
| 2016/0370052 | A1 | 12/2016 | Yang |
| 2017/0082349 | A1 | 3/2017 | Jung |
| 2017/0191744 | A1 | 7/2017 | Koo |
| 2017/0343273 | A1 | 11/2017 | Cheon |
| 2017/0370631 | A1 | 12/2017 | Kim |
| 2018/0038626 | A1 | 2/2018 | Kim |
| 2018/0087827 | A1 | 3/2018 | Lee |
| 2018/0141718 | A1 | 5/2018 | Ahlstrom |
| 2018/0142941 | A1 | 5/2018 | Arslandkiray |
| 2018/0156529 | A1 | 6/2018 | Wantland et al. |
| 2018/0172337 | A1 | 6/2018 | Choi et al. |
| 2018/0187951 | A1 | 7/2018 | Seo |
| 2018/0187955 | A1 | 7/2018 | Son |
| 2018/0187957 | A1 | 7/2018 | Seo |
| 2018/0223582 | A1 | 8/2018 | Shin |
| 2018/0231299 | A1 | 8/2018 | Koo |
| 2018/0274846 | A1 | 9/2018 | Kim |
| 2018/0283768 | A1 | 10/2018 | Raab et al. |
| 2018/0292127 | A1 | 10/2018 | Park |
| 2018/0320952 | A1 | 11/2018 | Joo et al. |
| 2019/0024962 | A1 | 1/2019 | Lee |
| 2019/0053685 | A1 | 2/2019 | Chwalibog |
| 2019/0086141 | A1 | 3/2019 | Kim et al. |
| 2019/0120547 | A1 | 4/2019 | Staub |
| 2019/0145140 | A1 | 5/2019 | Zhang |
| 2019/0178277 | A1 | 6/2019 | Schmidt et al. |
| 2020/0072544 | A1 | 3/2020 | Lee |
| 2020/0284503 | A1 | 9/2020 | Gerstmayr |
| 2020/0326119 | A1 | 10/2020 | Lee |
| 2023/0012438 | A1* | 1/2023 | Hong ..... F25D 23/028 |
| 2023/0108392 | A1* | 4/2023 | Hong ..... F25D 23/085 312/405 |
| 2024/0085094 | A1 | 3/2024 | Lee et al. |

FOREIGN PATENT DOCUMENTS

| | | | |
|---|---|---|---|
| CN | 1075001 | A | 8/1993 |
| CN | 2499768 | Y | 7/2002 |
| CN | 1576757 | A | 2/2005 |
| CN | 101231114 | A | 7/2008 |
| CN | 201225804 | Y | 4/2009 |
| CN | 201731722 | U | 2/2011 |
| CN | 102778099 | A | 11/2012 |
| CN | 103388953 | A | 11/2013 |
| CN | 203771878 | U | 8/2014 |
| CN | 104457115 | A | 3/2015 |
| CN | 104603561 | A | 5/2015 |
| CN | 204 478 688 | U | 7/2015 |
| CN | 205860639 | U | 1/2017 |
| CN | 106796077 | A | 5/2017 |
| CN | 106 802 056 | A | 6/2017 |
| CN | 106949692 | A | 7/2017 |
| CN | 107328161 | A | 11/2017 |
| CN | 107677035 | | 2/2018 |
| CN | 107883659 | A | 4/2018 |
| CN | 207299701 | U | 5/2018 |
| CN | 109 974 369 | A | 7/2019 |
| CN | 210130729 | U | 3/2020 |
| CN | 112714855 | B | 2/2023 |
| DE | G 93 02 426.6 | U1 | 6/1994 |
| DE | 29603458 | U1 | 5/1996 |
| DE | 10 2007 021 557 | A1 | 11/2008 |
| DE | 10 2008 019 421 | A1 | 10/2009 |

(56) References Cited

FOREIGN PATENT DOCUMENTS

| | | | |
|---|---|---|---|
| DE | 21 2015 000 209 | U1 | 5/2017 |
| DE | 10 2017 213 909 | A1 | 2/2019 |
| EP | 543696 | A1 | 5/1993 |
| EP | 0647821 | A | 4/1995 |
| EP | 1 477 753 | A1 | 11/2004 |
| EP | 2 730 869 | A2 | 5/2014 |
| EP | 2 843 329 | A2 | 3/2015 |
| EP | 2 843 330 | A2 | 3/2015 |
| EP | 2 843 330 | A3 | 11/2015 |
| EP | 3 333 515 | A1 | 6/2018 |
| EP | 3 441 704 | A1 | 2/2019 |
| EP | 3 147 605 | A1 | 3/2019 |
| EP | 3 857 144 | B1 | 6/2023 |
| GB | 1 038 499 | A | 8/1966 |
| GB | 2050814 | A | 1/1981 |
| JP | S45-1490 | Y1 | 1/1970 |
| JP | 55-10981 | | 1/1980 |
| JP | 6-312464 | A | 11/1994 |
| JP | 07-022382 | U | 4/1995 |
| JP | 7-91816 | | 4/1995 |
| JP | 2000-146422 | A | 5/2000 |
| JP | 2006-194545 | | 7/2006 |
| JP | 2014-43998 | | 3/2014 |
| JP | 2014-52156 | | 3/2014 |
| JP | 2014-52175 | | 3/2014 |
| JP | 2014-231974 | A | 12/2014 |
| JP | 2015-203510 | | 11/2015 |
| JP | 2015-206478 | | 11/2015 |
| JP | 2016-38142 | | 3/2016 |
| JP | 2016-50760 | | 4/2016 |
| JP | 2016-156556 | A | 9/2016 |
| KR | 20-0319637 | Y1 | 7/2003 |
| KR | 2003-0057087 | A | 7/2003 |
| KR | 10-2003-0084071 | A | 11/2003 |
| KR | 10-0432749 | B1 | 5/2004 |
| KR | 10-2005-0007108 | | 1/2005 |
| KR | 10-2005-0099051 | A | 10/2005 |
| KR | 1020050104119 | A | 11/2005 |
| KR | 10-0634365 | B1 | 10/2006 |
| KR | 10-2007-0008823 | A | 1/2007 |
| KR | 10-0678674 | B1 | 2/2007 |
| KR | 10-2007-0068933 | A | 7/2007 |
| KR | 10-0751015 | B1 | 8/2007 |
| KR | 10-2008-0057471 | A | 6/2008 |
| KR | 10-0861352 | B1 | 10/2008 |
| KR | 10-0864724 | B1 | 10/2008 |
| KR | 10-0877989 | B1 | 1/2009 |
| KR | 10-2010-0057246 | A | 5/2010 |
| KR | 10-2012-0039618 | A | 4/2012 |
| KR | 10-2013-0053549 | A | 5/2013 |
| KR | 10-1307862 | B1 | 9/2013 |
| KR | 10-1367034 | B1 | 3/2014 |
| KR | 10-2014-0060431 | A | 5/2014 |
| KR | 10-1520691 | B1 | 5/2015 |
| KR | 10-2015-0061213 | A | 6/2015 |
| KR | 10-2015-0082062 | | 7/2015 |
| KR | 10-2015-0082063 | A | 7/2015 |
| KR | 10-2017-0093994 | A | 8/2017 |
| KR | 10-2018-0022232 | A | 3/2018 |
| KR | 10-2018-0077586 | | 7/2018 |
| KR | 10-2018-0080084 | | 7/2018 |
| KR | 10-1895086 | B1 | 9/2018 |
| RU | 1778471 | A1 | 11/1992 |
| RU | 2259520 | C2 | 8/2005 |
| RU | 2432533 | C2 | 10/2011 |
| RU | 2 437 042 | C2 | 12/2011 |
| RU | 2449228 | C2 | 4/2012 |
| RU | 2478174 | C2 | 3/2013 |
| RU | 2553249 | C2 | 6/2015 |
| RU | 2636160 | C1 | 11/2017 |
| WO | WO 2004/104502 | A1 | 12/2004 |
| WO | WO 2006/112633 | A1 | 10/2006 |
| WO | WO 2009/114706 | A1 | 9/2009 |
| WO | WO 2010/141980 | A1 | 12/2010 |
| WO | 2014/038190 | A1 | 3/2014 |
| WO | WO 2015/033754 | A1 | 3/2015 |
| WO | WO 2016/111499 | A1 | 7/2016 |
| WO | WO 2017/007164 | A1 | 1/2017 |
| WO | WO 2017/119614 | A1 | 7/2017 |

OTHER PUBLICATIONS

Office Action dated May 10, 2024, issued in European Patent Application No. 23 193 354.0.

Office Action dated Jun. 7, 2024, issued in European Patent Application No. 20 208 102.2.

Office Action dated Jun. 26, 2024, issued in European Patent Application No. 20 790 595.1.

Office Action dated Jul. 4, 2024, issued in Australian Patent Application No. 2023210665.

Office Action dated Apr. 29, 2024, issued in Mexico Patent Application No. MX/a/2021/001869.

Office Action dated Jun. 14, 2024, issued in U.S. Appl. No. 18/519,298.

Office Action dated Feb. 13, 2024, issued in European Application No. 20 208 041.2.

Office Action dated Feb. 28, 2024, issued in European Application No. 20 790 595.1.

Office Action dated Dec. 20, 2023, in India Application No. P00202101135.

Office Action dated Feb. 7, 2024, in European Application No. 20 208 115.4.

Notice of Allowance dated Jan. 21, 2021, in U.S. Appl. No. 16/950,663.

Korean Office Action dated Jan. 10, 2021, in corresponding Korean Patent Application No. 10-2020-0063401.

Korean Office Action dated Jan. 24, 2021, in corresponding Korean Patent Application No. 10-2020-0152503.

Korean Office Action dated Jan. 28, 2021, in corresponding Korean Patent Application No. 10-2020-0152558.

International Search Report Dated Dec. 15, 2020, in corresponding International Patent Application No. PCT?KR2020/010518.

Non-Patent Literature, "New Chief Collection", NEWS (Jul. 2, 2020) (http://www.handkookilbo.com/News/Read/A202007020950000365?did=NA).

Non-Patent Literature, "New Samsung Bespoke Refrigerator", NEWS (Apr. 9, 2020) (http://www/mk/co/kr/news/business/view/2020/04/375019/).

Notice of Allowance dated Mar. 10, 2021, in U.S. Appl. No. 16/950,663.

Office Action dated Apr. 1, 2021, in U.S. Appl. No. 17/171,337.

Extended European Search Report dated Apr. 20, 2021, in corresponding European Patent Application No. 20208048.7-1009.

Extended European Search Report dated Mar. 22, 2021, in corresponding European Patent Application No. 202008034.7-1009.

Extended European Search Report dated Mar. 19, 2021, in corresponding European Patent Application No. 20208041.2-1009.

Extended European Search Report dated Mar. 22, 2021, in corresponding European Patent Application No. 20208102.2-1009.

Extended European Search Report dated Mar. 23, 2021, in corresponding European Patent Application No. 20208110.5-1009.

Extended European Search Report dated Mar. 22, 2021, issued in corresponding European Patent Application No. 20208115.4-1009.

Notice of Allowance dated Apr. 15, 2021 in co-pending U.S. Appl. No. 17/184,970.

English translation of JP2014231974A; Dec. 11, 2014.

Office Action dated May 5, 2021, in co-pending U.S. Appl. No. 17/099,627.

Notice of Allowance date May 13, 2021, in co-pending U.S. Appl. No. 17/184,970.

International Search Report dated Apr. 28, 2021, in corresponding International Patent Application No. PCT/KR2021/001068.

Korean Office Action dated Jun. 29, 2021, in Korean Patent Application No. 10-2021-007565.

Extended European Search Report dated Jul. 1, 2021, in corresponding European Patent Application No. 20800542.1.

(56) References Cited

OTHER PUBLICATIONS

Korean Office Action dated May 10, 2021, in corresponding Korean patent Application No. 10-2020-0063401.
Extended European Search Report dated Jun. 21, 2021, in corresponding European Patent Application No. 21159518.6.
Communication pursuant to Article 94(3) EPC dated Jul. 15, 2021, in corresponding European Patent Application No. 20 208 096.6.
Extended European Search Report dated Jun. 22, 2021, in corresponding European Patent Application No. 21159524.4.
Korean Office Action dated Jun. 29, 2021, in corresponding Korean Patent Application No. 10-2021-0074588.
Non-Final Action issued in U.S. Appl. No. 16/950,676 on Aug. 31, 2021.
Non-Final Office Action issued in U.S. Appl. No. 16/950,678 on Aug. 19, 2021.
Non-Final Office Action issued in U.S. Appl. No. 16/950,682 on Aug. 19, 2021.
Non-Final Office Action issued in U.S. Appl. No. 16/950,773 on Sep. 1, 2021.
Non-Final Office Action issued in U.S. Appl. No. 16/998,908 on Jun. 18, 2021.
Final Rejection issued in U.S. Appl. No. 16/998,908 on Oct. 13, 2021.
Final Office Action issued in U.S. Appl. No. 16/998,908 on Oct. 13, 2021.
Non-Final Office Action issued in U.S. Appl. No. 17/099,627 on Oct. 28, 2021.
Notice of Allowance issued in U.S. Appl. No. 16/950,673 on Dec. 8, 2021.
Office Action issued in U.S. Appl. No. 17/474,576 on Dec. 7, 2021.
Office Action issued in U.S. Appl. No. 17/474,594 on Dec. 7, 2021.
Notice of Allowance issued in U.S. Appl. No. 16/950,773 on Dec. 10, 2021.
Non-Final Rejection issued in U.S. Appl. No. 16/849,209 on Oct. 1, 2021.
Non-Final Rejection issued in U.S. Appl. No. 17/099,661 on Oct. 4, 2021.
Non-Final Rejection issued in U.S. Appl. No. 17/099,689 on Oct. 4, 2021.
Extended European Search Report dated Oct. 1, 2021, in corresponding European Patent Application No. 21180812.6.
Extended European Search Report dated Oct. 1, 2021, in corresponding European Patent Application No. 21180820.9.
Chinese Office Action dated Oct. 9, 2021, in corresponding Chinese Patent Application No. 202110250149.5.
Extended European Search Report dated Dec. 2, 2021, in corresponding European Patent Application No. 21701195.6.
Notice of Allowance issued in U.S. Appl. No. 17/185,384 on Jan. 4, 2022.
Office Action issued in U.S. Appl. No. 17/480,854 on Jan. 6, 2022.
Advisory Action issued in U.S. Appl. No. 16/998,908 on Jan. 19, 2022.
Office Action issued in U.S. Appl. No. 16/950,678 on Jan. 18, 2022.
Search Report dated Dec. 6, 2021, in corresponding Russian Patent Application No. 2021104790.
Notice of Allowance dated Dec. 10, 2021, in corresponding Russian Patent Application No. 2021104602.
Search Report dated Dec. 13, 2021, in corresponding Russian Patent Application No. 2021104792.
Chinese Office Action dated Dec. 16, 2021, corresponding Chinese Patent Application No. 202080004419.8.
Chinese Office Action dated Dec. 27, 2021, in corresponding Chinese Patent Application No. 202080004516.7.
Chinese Office Action dated Jan. 20, 2022, in corresponding Chinese Patent Application No. 202110684887.0.
Notice of Allowance issued in U.S. Appl. No. 16/950,682 on Jan. 21, 2022.
Notice of Allowance issued in U.S. Appl. No. 16/849,209 on Jan. 26, 2022.
Notice of Allowance issued in U.S. Appl. No. 17/099,661 on Jan. 26, 2022.
Notice of Allowance issued in U.S. Appl. No. 17/480,388 on Jan. 26, 2022.
Corrected Notice of Allowability issued in U.S. Appl. No. 16/950,773 on Jan. 19, 2022.
Corrected Notice of Allowability issued in U.S. Appl. No. 16/950,773 on Feb. 2, 2022.
Corrected Notice of Allowance issued in U.S. Appl. No. 17/185,384 on Jan. 28, 2022.
Corrected Notice of Allowance issued in U.S. Appl. No. 16/950,673 on Jan. 18, 2022.
Corrected Notice of Allowance issued in U.S. Appl. No. 16/950,673 on Jan. 28, 2022.
Notice of Allowability issued in U.S. Appl. No. 16/950,682 on Feb. 2, 2022.
Office Action issued in U.S. Appl. No. 16/998,908 on Feb. 11, 2022.
Notice of Allowance issued in U.S. Appl. No. 17/480,854 on Mar. 7, 2022.
Office Action issued in U.S. Appl. No. 17/502,677 on Dec. 2, 2021.
Notice of Allowance issued in U.S. Appl. No. 17/474,576 on Mar. 16, 2022.
Notice of Allowance issued in U.S. Appl. No. 17/474,594 on Mar. 17, 2022.
Notice of Allowance issued in U.S. Appl. No. 16/950,678 on Mar. 29, 2022.
Office Action issued in U.S. Appl. No. 17/099,689 on Mar. 21, 2022.
Notice of Allowance issued on Jan. 28, 2022, in Koran Patent Application No. 10- 2020-0171257.
Communication under Rule 71(3) issued on Mar. 14, 2022, in European Application No. 20 208 110.5-1009.
Chinese Office Action dated Mar. 25, 2022, in Chinese Patent Application No. 202110219861.9.
Chinese Office Action dated May 6, 2022, in Chinese Patent Application No. 202110250149.5.
Extended European Search Report dated May 6, 2022, in European Patent Application No. 22153645.1.
European Office Action dated May 12, 2022, European Patent Application No. 21 701 195.6.
Office Action dated May 24, 2022, in U.S. Appl. No. 17/502,677.
Office Action dated May 23, 2022, in U.S. Appl. No. 17/099,628.
Notice of Allowance issued May 31, 2022, in U.S. Appl. No. 17/099,689.
Office Action dated Jun. 29, 2022 in Chinese Application No. 202110218847.7.
Office Action dated Jul. 5, 2022 in Chinese Application No. 202110208951.8.
Office Action dated Jul. 11, 2022 in Chinese Application No. 202110684887.0.
Notice of Allowance issued in U.S. Appl. No. 17/673,439 on Apr. 20, 2022.
Corrected Notice of Allowability issued in U.S. Appl. No. 17/673,439 on Jun. 14, 2022.
Corrected Notice of Allowability issued in U.S. Appl. No. 17/673,439 on Jun. 24, 2022.
Extended European Search Report dated Jul. 21, 2022, issued in European Application No. 20790595.
Office Action dated Aug. 12, 2022, issued in Russian Application No. 2021104792.
Office Action dated Aug. 22, 2022, issued in Chinese Application No. 202080004516.7.
Office Action dated Aug. 25, 2022, issued in Australian Application No. 2022206716.
Office Action dated Aug. 29, 2022, issued in Australian Application No. 2022206717.
Office Action dated Aug. 30, 2022, issued in Australian Application No. 2022206718.
English Translation for JPH0722382 (Year: 1995).
Office Action dated Oct. 3, 2022, issued in U.S. Appl. No. 17/502,677.
Office Action dated Sep. 28, 2022, issued in U.S. Appl. No. 17/099,627.
Non-Final Office Action dated Dec. 29, 2022, issued in U.S. Appl. No. 17/869,089.

(56) References Cited

OTHER PUBLICATIONS

Office Action dated Nov. 8, 2022 issued in Chinese Application No. 202110219861.9.
Office Action dated Nov. 23, 2022 issued in Australian Application No. 2022206717.
Office Action dated Aug. 22, 2022 issued in Australian Application No. 2022206715.
Office Action dated Nov. 25, 2022 issued in European Application No. 21 701 195.6.
Office Action dated Nov. 29, 2022 issued in European Application No. 22 153 645.1.
Office Action dated Dec. 19, 2022 issued in Australian Application No. 2022206716.
Office Action dated Dec. 12, 2022 issued in European Application No. 21 159 518.6.
Office Action dated Jan. 16, 2023 issued in Chinese Application No. 202110218847.7.
Office Action dated Jan. 20, 2023 issued in Chinese Application No. 202110208951.8.
Office Action dated Nov. 29, 2022 issued in European Application No. 20 800 542.1.
Office Action dated Dec. 13, 2022 issued in Australian Application No. 2022206718.
Office Action dated Feb. 13, 2023, in U.S. Appl. No. 17/953,005.
Office Action issued Mar. 1, 2023, in Australian Application No. 2023200150.
Office Action issued on Feb. 27, 2023, in Korean Application No. 10-2020-0152603.
Office Action issued Apr. 19, 2023, in European Application No. 20 208 115.4.
Office Action issued Mar. 2, 2023, in Australian Application No. 2022206715.
Office Action issued Apr. 4, 2023, in European Application No. 21 701 195.6.
Office Action issued May 9, 2023, in European Application No. 21 159 524.4.
Office Action issued on Apr. 5, 2023, in European Application No. 20 208 034.7.
Office Action issued on Apr. 6, 2023, in Indonesian Application No. P00202101028.
Office Action issued on May 2, 2023, in India Application No. 202117007903.
Office Action issued on May 9, 2023, in European Application No. 20 208 041.2.
Notice of Allowance dated May 19, 2023, in U.S. Appl. No. 17/502,677.
Corrected Notice of Allowance dated May 30, 2023, in U.S. Appl. No. 17/502,677.
Office Action dated Jun. 14, 2023, in European Application No. 23 162 903.1.
Office Action dated Jul. 13, 2023, in Indonesia Application No. P-00202100825.
Office Action dated Jun. 28, 2023, in European Application No. 20 208 048.7.
Office Action dated Jun. 30, 2023, in Australia Application No. 2020258215.
Office Action dated Jul. 26, 2023, in Vietnam Application No. 38250/SHTT-SC.
Final Office Action dated Sep. 12, 2023, issued in U.S. Appl. No. 17/869,089.
Notice of Allowance dated Nov. 16, 2023, issued in U.S. Appl. No. 17/869,089.
Corrected Notice of Allowability dated Dec. 18, 2023, issued in U.S. Appl. No. 17/869,089.
Notice of Allowance dated May 18, 2023, in U.S. Appl. No. 17/099,627.
European Search Report dated Sep. 21, 2023, in European Application No. 23 16 2903.
Office Action dated Sep. 22, 2023, in India Application No. 202118008042.
European Search Report dated Oct. 13, 2023, in European Application No. 20 208 041.2.
European Search Report dated Sep. 11, 2023, in European Application No. 23 19 3354.
U.S. Appl. No. 16/950,663, filed Nov. 17, 2020, Chomin Lee, Samsung Electronics Co., Ltd.
U.S. Appl. No. 16/950,673, filed Nov. 17, 2020, Chomin Lee, Samsung Electronics Co., Ltd.
U.S. Appl. No. 16/950,678, filed Nov. 17, 2020, Chomin Lee, Samsung Electronics Co., Ltd.
U.S. Appl. No. 16/950,682, filed Nov. 17, 2020, Chomin Lee, Samsung Electronics Co., Ltd.
U.S. Appl. No. 17/171,337, filed Feb. 9, 2021, Chomin Lee, Samsung Electronics Co., Ltd.
U.S. Appl. No. 16/849,209, filed Apr. 15, 2020, Chomin Lee, Samsung Electronics Co., Ltd.
U.S. Appl. No. 17/099,627, filed Nov. 16, 2020, Chomin Lee, Samsung Electronics Co., Ltd.
U.S. Appl. No. 17/099,661, filed Nov. 16, 2020, Chomin Lee, Samsung Electronics Co., Ltd.
U.S. Appl. No. 17/099,689, filed Nov. 16, 2020, Chomin Lee, Samsung Electronics Co., Ltd.
U.S. Appl. No. 16/950,773, filed Nov. 17, 2020, Sungdeuk Park, Samsung Electronics Co., Ltd.
U.S. Appl. No. 17/184,970, filed Feb. 25, 2021, Sungdeuk Park, Samsung Electronics Co., Ltd.
U.S. Appl. No. 17/185,384, filed Feb. 25, 2021, Sungdeuk Park, Samsung Electronics Co., Ltd.
U.S. Appl. No. 16/998,908, filed Aug. 20, 2020, Chomin Lee, Samsung Electronics Co., Ltd.
U.S. Appl. No. 17/502,677, filed Oct. 15, 2021, Chomin Lee, Samsung Electronics Co., Ltd.
U.S. Appl. No. 17/480,388, filed Sep. 21, 2021, Chomin Lee, Samsung Electronics Co., Ltd.
U.S. Appl. No. 17/673,439, filed Feb. 16, 2022, Sungdeuk Park, Samsung Electronics Co., Ltd.
U.S. Appl. No. 18/232,997, filed Aug. 22, 2024, Chomin Lee, Samsung Electronics Co., Ltd.
U.S. Appl. No. 17/480,854, filed Sep. 21, 2021, Chomin Lee, Samsung Electronics Co., Ltd.
U.S. Appl. No. 17/474,576, filed Sep. 14, 2021, Chomin Lee, Samsung Electronics Co., Ltd.
U.S. Appl. No. 17/474,594, filed Sep. 14, 2021, Chomin Lee, Samsung Electronics Co., Ltd.
U.S. Appl. No. 17/869,089, filed Jul. 20, 2022, Sungdeuk Park, Samsung Electronics Co., Ltd.
U.S. Appl. No. 18/437,957, filed Feb. 9, 2024, Sungdeuk Park, Samsung Electronics Co., Ltd.
U.S. Appl. No. 17/953,005, filed Sep. 26, 2022, Chomin Lee, Samsung Electronics Co., Ltd.
Office Action dated Feb. 29, 2024, in U.S. Appl. No. 18/232,997.
Office Action dated Sep. 5, 2024, in U.S. Appl. No. 18/232,997.
Office Action dated Jun. 17, 2024 issued in Vietnamese Application No. 1-2021-00824.
Office Action dated Jul. 22, 2024 issued in Mexican Application No. MX/a/2021/001927.
Office Action dated Aug. 6, 2024 issued in Columbia Application No. NC2022/0015916.
Office Action dated Sep. 3, 2024 issued in European Application No. 23 193 354.0.
Office Action dated Sep. 9, 2024 issued in European Application No. 20 208 102.2.
Office Action dated Sep. 17, 2024 issued in Mexican Application No. MX/a/2021/001869.
Office Action dated Oct. 30, 2024 issued in Chinese Application No. 202210512108.3.
Office Action dated Nov. 5, 2024 issued in Chinese Application No. 202211336881.5.
Office Action dated Nov. 6, 2024 issued in Chinese Application No. 202211045143.5.
European Search Report dated Nov. 6, 2024 issued in European Application No. EP 24 19 4454.

(56) References Cited

OTHER PUBLICATIONS

Office Action dated Nov. 14, 2024 issued in Chinese Application No. 202211336189.2.
U.S. Appl. No. 18/232,997, filed Aug. 11, 2023, Chomin Lee et al., Samsung Electronics Co., Ltd.
U.S. Appl. No. 18/519,298, filed Nov. 27, 2023, Chomin Lee, Samsung Electronics Co., Ltd.
Notice of Allowance dated Dec. 26, 2024, in U.S. Appl. No. 18/232,997.
Notice of Allowance dated Dec. 18, 2024, in U.S. Appl. No. 18/519,298.
Office Action dated Nov. 30, 2024, in Chinese Application No. 202211336118.2.
Office Action dated Dec. 12, 2024, in European Application No. 20 208 034.7.
Office Action dated Dec. 19, 2024, in Chinese Application No. 202210122022.X.

* cited by examiner

REFRIGERATOR

CROSS-REFERENCE TO RELATED APPLICATION

This application is a continuation of U.S. Ser. No. 17/869,089, filed Jul. 20, 2022, which is a continuation of US Ser. No. 17,673,439, filed Feb. 16, 2022, which is a continuation of U.S. Ser. No. 17/185,384, filed Feb. 25, 2021, which is a continuation of U.S. Ser. No. 16/950,773, filed Nov. 17, 2020, and is based on and claims priority under 35 U.S.C. § 119 to Korean Patent Application No. 10-2020-0043017 filed on Apr. 8, 2020, and Korean Patent Application No. 10-2020-0152722 filed on Nov. 16, 2020. The disclosures of U.S. Ser. No. 17/869,089, US Ser. No. 17,673,439, U.S. Ser. No. 17/185,384, U.S. Ser. No. 16/950,773, Korean Patent Application No. 10-2020-0043017, and Korean Patent Application No. 10-2020-0152722 are herein incorporated by reference in their entireties.

BACKGROUND

1. Field

The disclosure relates to a refrigerator, and more particularly, to a refrigerator having a door with a decoration panel attached to the front.

2. Discussion of Related Art

Refrigerators are home appliances having a main body with storerooms and a cold air supply provided for supplying cold air into the storerooms, to keep food and groceries fresh. The storerooms include a fridge maintained at temperatures of about 0 to 5 degrees Celsius for keeping groceries cool, and a freezer maintained at temperatures of about 0 to −30 degrees Celsius for keeping groceries frozen. The storeroom commonly has an open front through which to take out or put in food, and the open front is opened or closed by a door.

The door may include a door body with insulation, and a decoration panel coupled to the front side of the door body. As the decoration panel may be readily attachable to and/or detachable from the front side of the door body, the user may easily replace the decoration panel with another decoration panel having different texture, color, or design to his/her liking.

SUMMARY

The disclosure provides a refrigerator with a door equipped with a decoration panel having a reduced number of parts and simple structure, thereby increasing productivity, lowering defect rates, and saving costs.

The disclosure also provides a refrigerator with a door equipped with a decoration panel giving an enhanced aesthetic sense and having firmness, and durability.

According to an aspect of the disclosure, a refrigerator includes a main body including a storeroom; a door body arranged to open or close the storeroom; a decoration panel coupled to a front side of the door body; and a holder mounted on the front side of the door body to be coupled to the decoration panel, wherein the door body includes a rear case defining a rear side of the door body; and a main case including a front part defining the front side of the door body and having an installation groove in which to install the holder, side parts defining sides of the door body, and a rear coupler coupled to the rear case, and wherein the main case is formed by bending a single metal board.

The front part may include a base formed to be flat, and a bending portion formed on both left and right sides of the base, and the bending portion may include an inner bending portion defining an inner side of the installation groove, a middle bending portion defining a rear side of the installation groove, and an outer bending portion defining an outer side of the installation groove.

The outer bending portion and the side part may be formed to contact each other by a hemming process.

The outer bending portion and the side part may be formed to be parallel to each other by a hemming process.

The outer bending portion and the side part may protrude farther forward than the base.

The middle bending portion may be formed to be perpendicular to the outer bending portion.

The inner bending portion may be formed to be tilted to base.

The main case may be formed of an iron plate material.

The installation groove may have an open front.

The refrigerator may further include a fastening member fastened to the holder and the installation groove to fix the holder to the installation groove.

The holder may include a case supporter supported on the bending portion, and the case supporter may include an inner supporter supported on the inner bending portion; a middle supporter supported on the middle bending portion; and an outer supporter supported on the outer bending portion.

The refrigerator may further include side trims attached to both left and right edges of a rear side of the decoration panel and coupled to the holder.

The holder may include a holder groove to which a side trim projection of the side trim is inserted, and a holder projection protruding from the case supporter to catch the side trim projection.

The decoration panel is formed of an iron plate material, and the holder may include a panel supporter supporting a left end or right end of the panel body.

According to another aspect of the disclosure, a refrigerator includes a main body including a first storeroom and a second storeroom formed under the first storeroom; a first door including a first door body arranged to open or close the first storeroom, a first decoration panel coupled to a front side of the first door body, and a first fixer fixing the first door body and the first decoration panel; and a second door including a second door body arranged to open or close the second storeroom, a second decoration panel coupled to a front side of the second door body, and a second fixer fixing the second door body and the second decoration panel, wherein the first fixer is coupled to a top end of the first door body and the second fixer is coupled to a bottom end of the second door body.

A handle may be formed on each of a bottom side of the first door body and a top side of the second door body.

The first decoration panel may include a first panel body, a first upper trim arranged at top edges of a rear side of the first panel body, and a first lower trim arranged at bottom edges of the rear side of the first panel body, and the first fixer may be coupled to the first upper trim.

The second decoration panel may include a second panel body, a second upper trim arranged at top edges of a rear side of the second panel body, and a second lower trim arranged at bottom edges of the rear side of the second panel body, and the second fixer may be coupled to the second lower trim.

The first door body may include an upper cap and a lower cap, the first fixer may be coupled to the upper cap of the first door body, and the first door body may have a handle formed at the lower cap.

The second door body may include an upper cap and a lower cap, the second door body may have a handle formed at the upper cap, wherein the second fixer may be coupled to the lower cap of the second door body.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION

Figure 1:
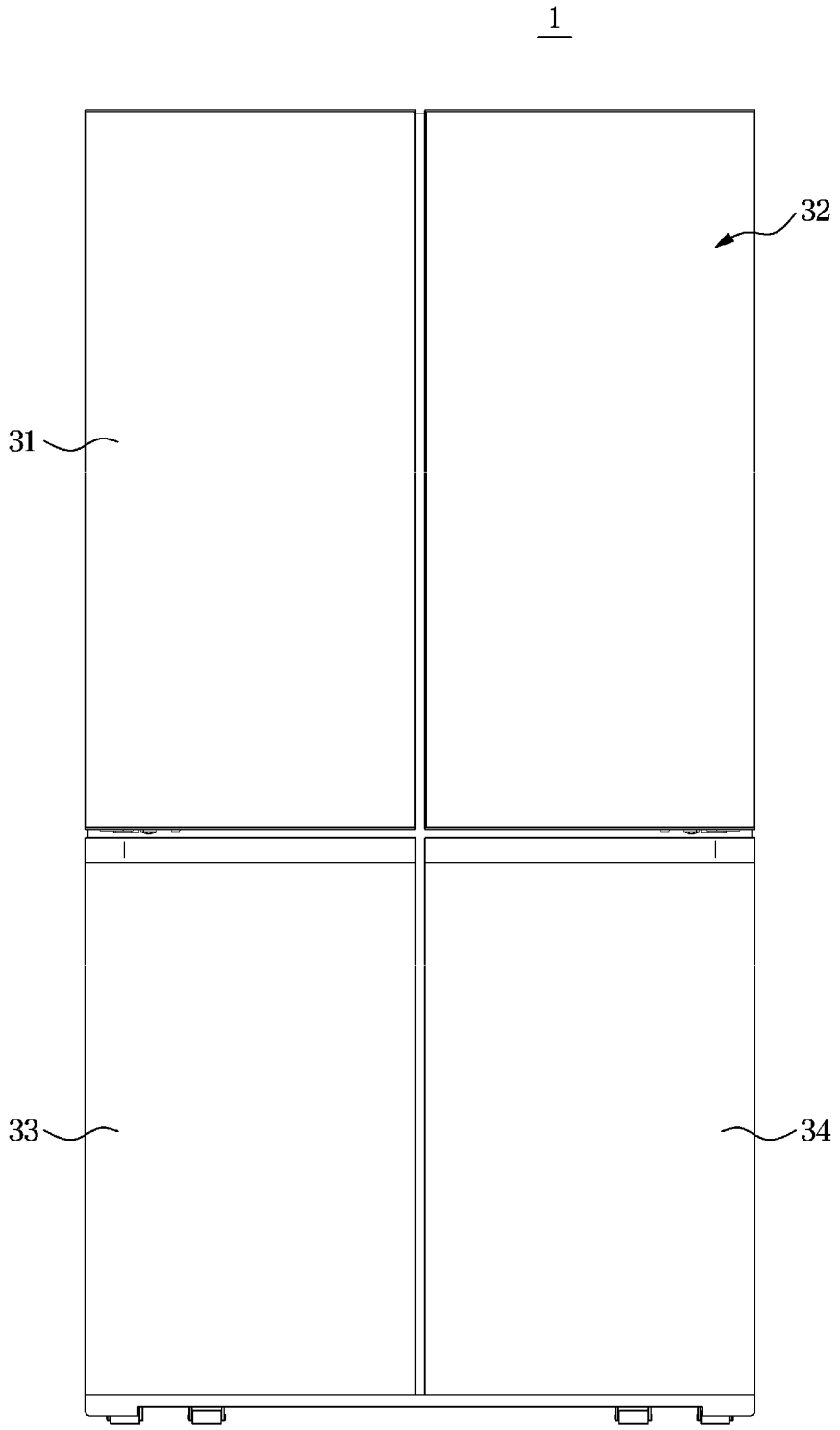
FIG. 1 illustrates a front view of a refrigerator, according to an embodiment of the disclosure.

Embodiments of the disclosure are only the most preferred examples and provided to assist in a comprehensive understanding of the disclosure as defined by the claims and their equivalents. Accordingly, those of ordinary skilled in the art will recognize that various changes and modifications of the embodiments described herein can be made without departing from the scope and spirit of the disclosure.

It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another.

Reference will now be made in detail to embodiments, examples of which are illustrated in the accompanying drawings, wherein like reference numerals refer to the like elements throughout.

Figure 2:
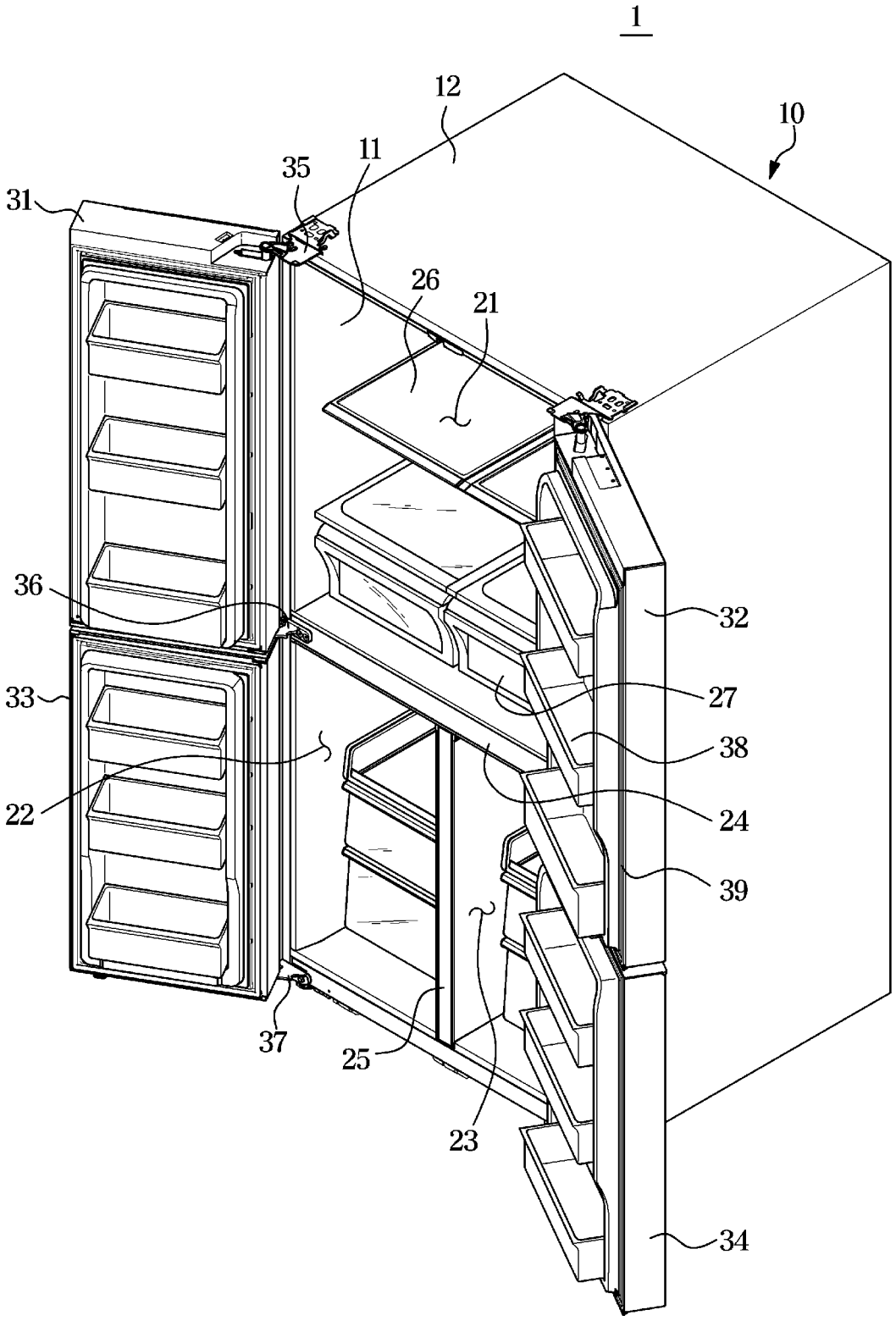
FIG. 2 illustrates a perspective view of the refrigerator of FIG. 1.

FIG. 1 illustrates a front view of a refrigerator, according to an embodiment of the disclosure. FIG. 2 illustrates a perspective view of the refrigerator of FIG. 1.

Referring to FIGS. 1 and 2, a refrigerator 1 may include a main body 10, storerooms 21, 22, and 23 formed inside the main body 10, doors 31, 32, 33, and 34 to open or close the storerooms 21, 22, and 23, and a cold air supply (not shown) for supplying cold air to the storerooms 21, 22, and 23.

The main body 10 may include an inner case 11 that defines the storerooms 21, 22, and 23, an outer case 12 coupled onto the outer side of the inner case 11 to define the exterior, and insulation (not shown) provided between the inner case 11 and the outer case 12 for insulating the storerooms 21, 22, and 23.

There may be a horizontal partition wall 24 and a vertical partition wall 25 to separate the plurality of storerooms 21, 22, and 23. The storerooms 21, 22, and 23 may be separated by the horizontal partition wall 24 into an upper storeroom 21 and the lower storerooms 22 and 23, and by the vertical partition wall 25 into the lower left storeroom 22 and the lower right storeroom 23.

The upper storeroom 21 may be used as a fridge, and the lower storerooms 22 and 23 may be used as freezers. How the storerooms 21, 22, and 23 are separated and used is not, however, limited thereto.

There may be shelves 26 on which to put groceries, and storage containers 27 for keeping groceries provided in the storerooms 21, 22, and 23.

The cold air supply may produce cold air using a cooling cycle for compressing, condensing, and evaporating refrigerants, and supply the cold air to the storerooms 21, 22, and 23.

The storeroom 21 may be opened or closed by a pair of upper doors 31 and 32. The upper doors 31 and 32 may be rotatably coupled to the main body 10. The storeroom 22 may be opened or closed by a door 33, which may be rotatably coupled to the main body 10. The storeroom 23 may be opened or closed by a lower right door 34, which may be rotatably coupled to the main body 10. The main body 10 may include hinges 35, 36, and 37 to couple the doors 31, 32, 33, and 34 to the main body 10.

Door guards 38 for storing foods, and door gaskets 39 may be tight on the front side of the main body 10 to seal the storerooms 21, 22, and 23 may be provided on the rear side of the doors 31, 32, 33, and 34.

Figure 3:
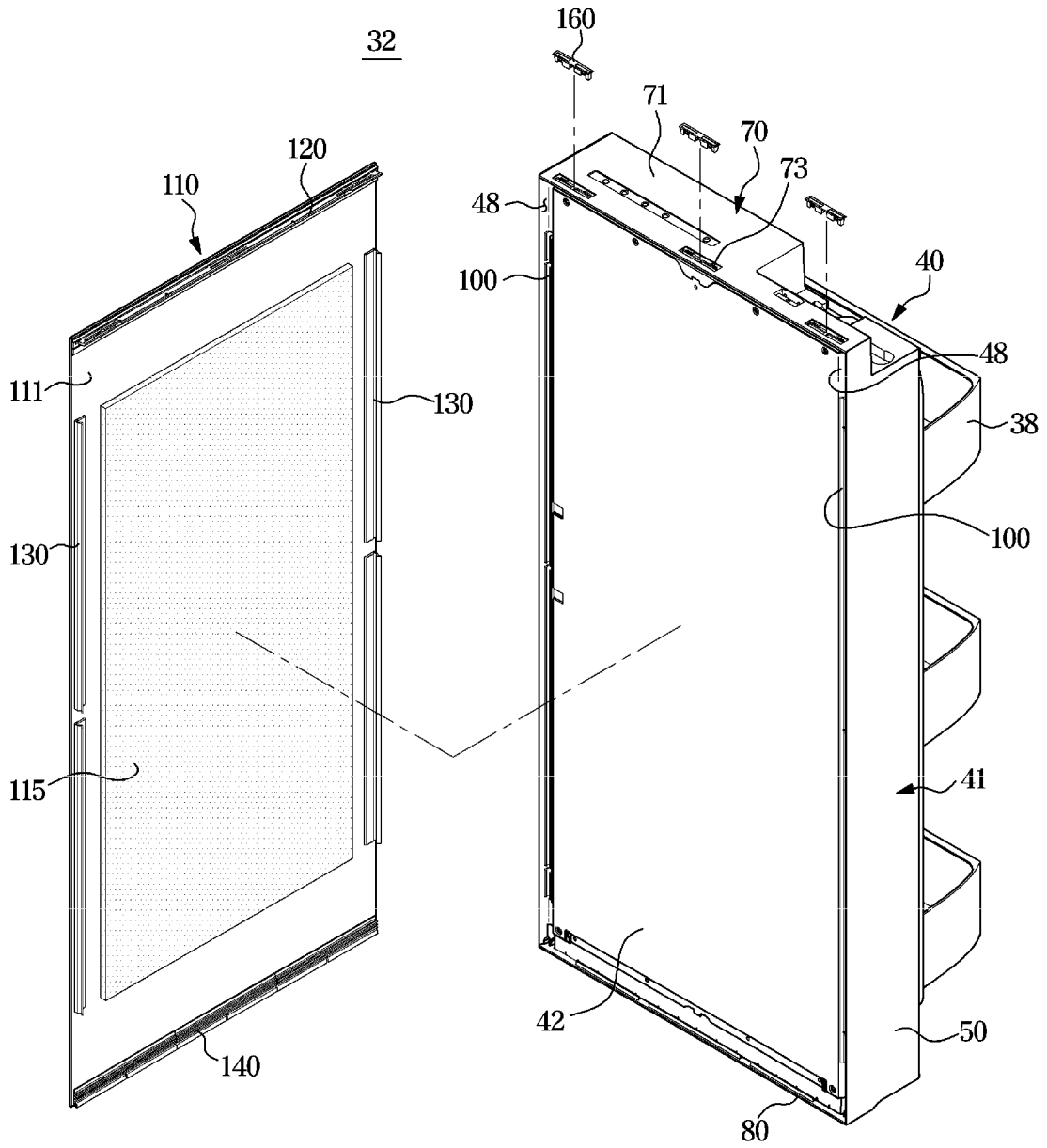
FIG. 3 illustrates a fridge door of the refrigerator of FIG. 1 broken down to a door body and a decoration panel.
Figure 4:
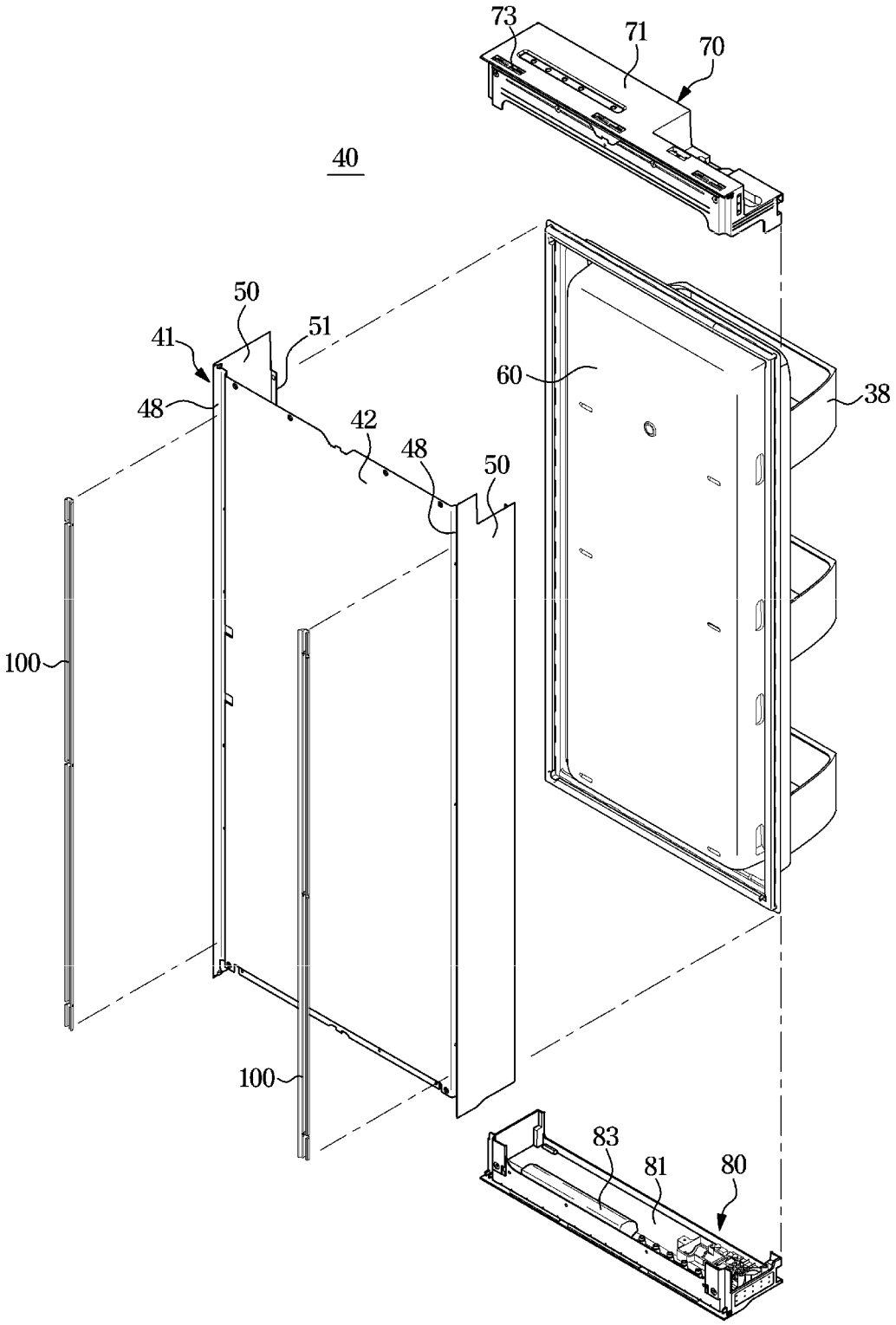
FIG. 4 illustrates an exploded view of a door body of a fridge door of the refrigerator of FIG. 1.
Figure 5:
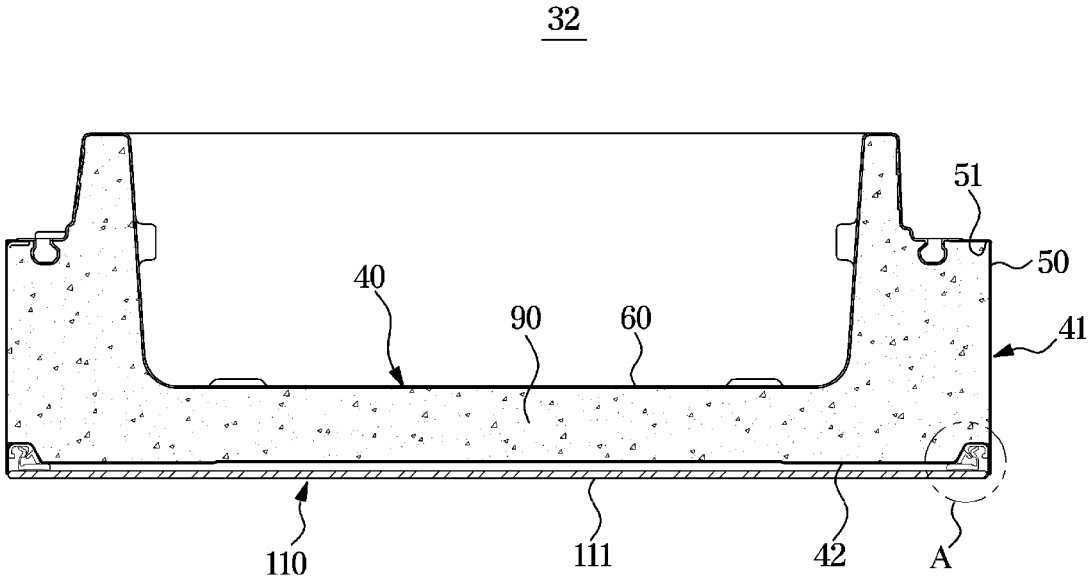
FIG. 5 illustrates a cross-sectional view of a fridge door of the refrigerator of FIG. 1.
Figure 6:
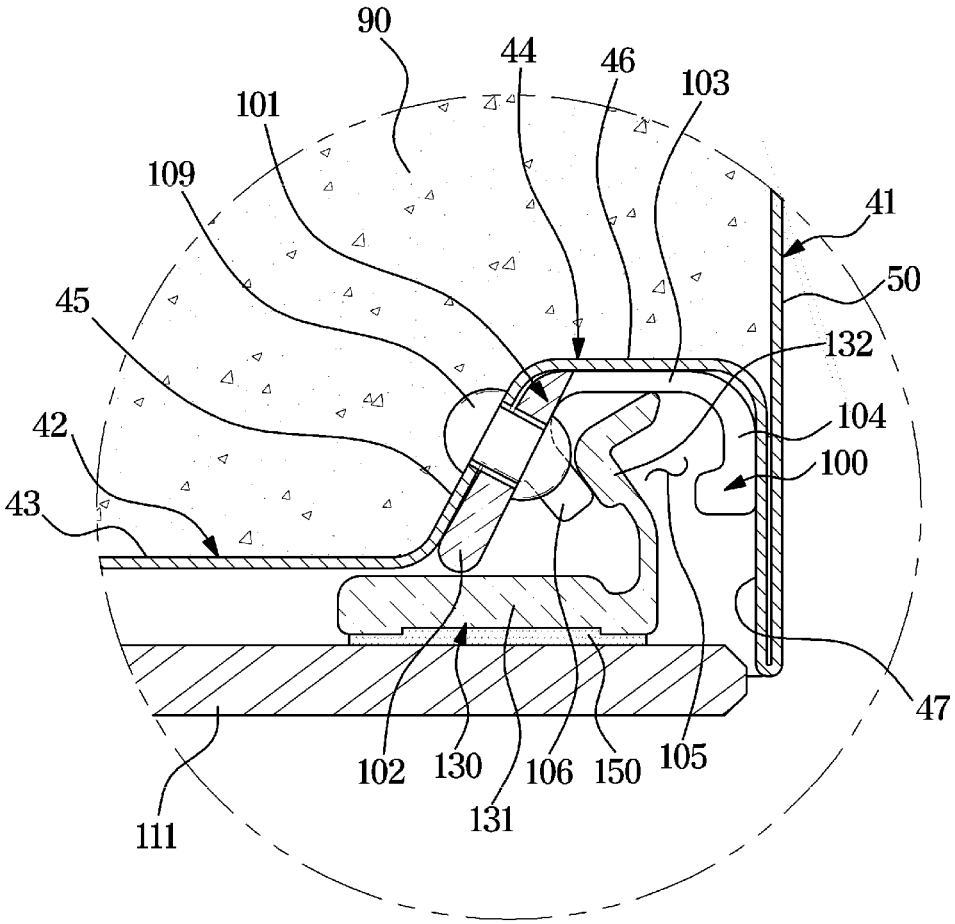
FIG. 6 illustrates an enlarged view of portion A of FIG. 5.
Figure 7:
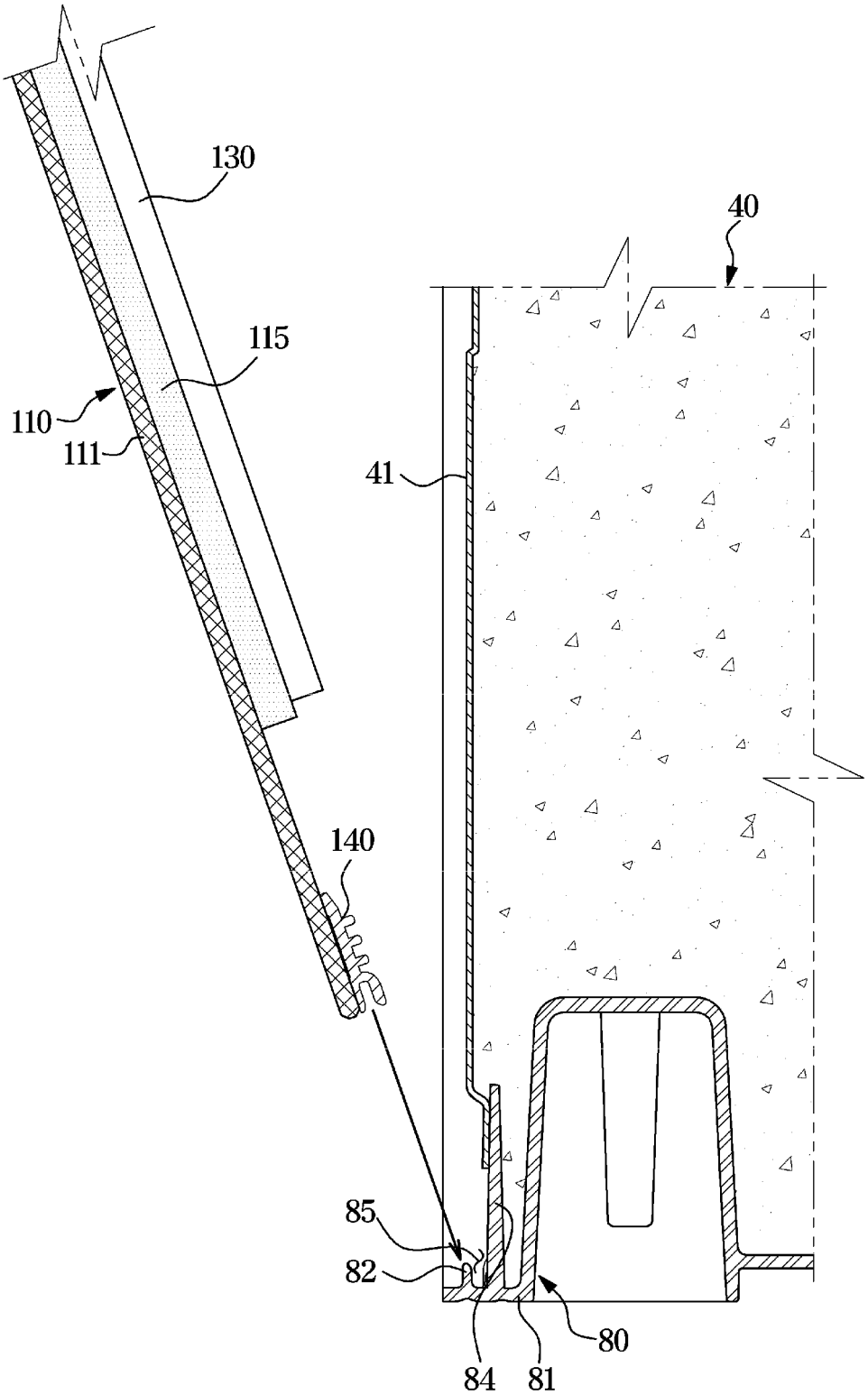
FIG. 7 illustrates an operation of coupling a decoration panel of a fridge door of the refrigerator of FIG. 1 to a door body.
Figure 8:
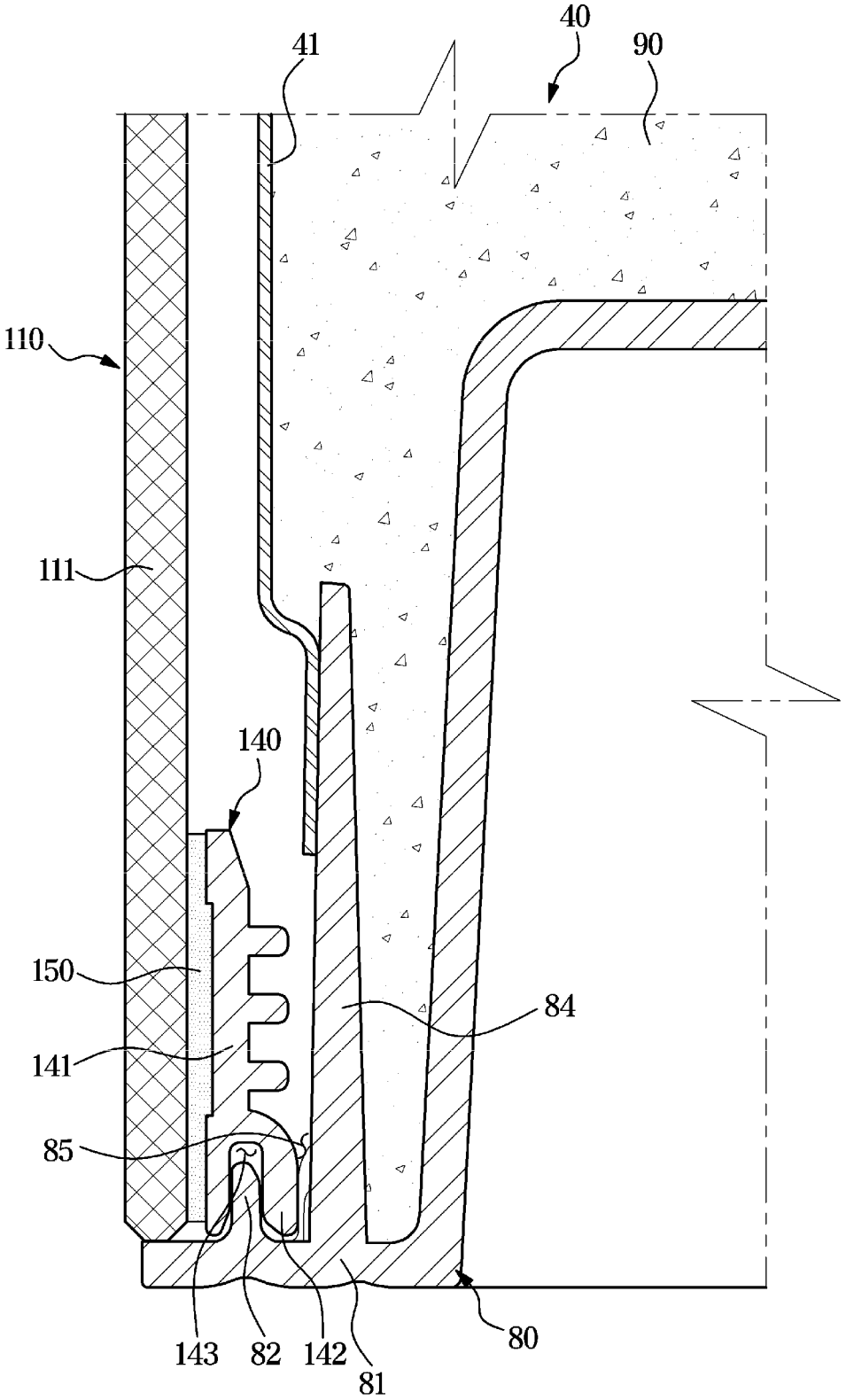
FIG. 8 illustrates a bottom coupling structure of a fridge door of the refrigerator of FIG. 1.
Figure 9:
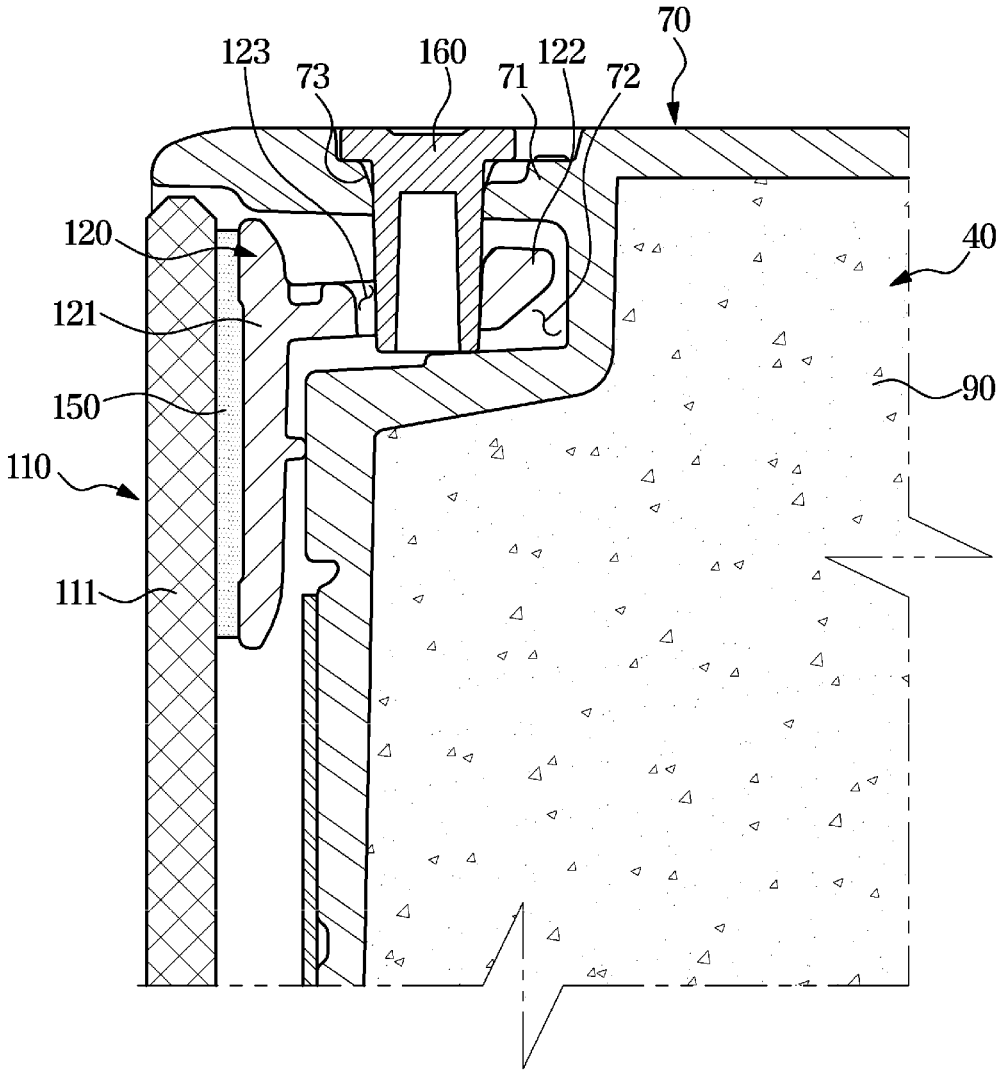
FIG. 9 illustrates a top coupling structure of a fridge door of the refrigerator of FIG. 1.

FIG. 3 illustrates a door of the refrigerator of FIG. 1 broken down to a door body and a decoration panel. FIG. 4 illustrates an exploded view of a door body of a fridge door of the refrigerator of FIG. 1. FIG. 5 illustrates a cross-sectional view of a fridge door of the refrigerator of FIG. 1. FIG. 6 illustrates an enlarged view of portion A of FIG. 5. FIG. 7 illustrates an operation of coupling a decoration panel of a fridge door of the refrigerator of FIG. 1 to a door body. FIG. 8 illustrates a bottom coupling structure of a fridge door of the refrigerator of FIG. 1. FIG. 9 illustrates a top coupling structure of a fridge door of the refrigerator of FIG. 1.

Referring to FIGS. 3 to 9, a structure of the upper doors 31 and 32 to open or close the upper storeroom 21 will be described. The following description will be focused on a structure of the upper right door 32, which may be equally applied to the upper left door 31, so the description of the upper left door 31 will not be repeated.

The door 32 may include a door body 40, and a decoration panel 110 coupled to the front side of the door body 40.

The decoration panel 110 may include a panel body 111, and trims 120, 130, and 140 attached to the rear side of the panel body 111 to be coupled with the door body 40. The panel body 111 may have a size corresponding to the door body 40. Accordingly, the front side of the door body 40 may be hidden by the panel body 111 and not be exposed.

The panel body 111 may have any of various textures, colors and designs. The decoration panel 110 may be formed to be readily attachable to and detachable from the front side of the door body 40. Accordingly, the door 32 may easily change the front texture, color, and design by replacing the decoration panel 110.

The panel body 111 may be formed of glass or a resin. The decoration panel 110 may include a buffering member 115 attached onto the rear side of the panel body 111 to soften the impact when the decoration panel 110 is coupled to the door body 40.

The trims 120, 130, and 140 may include an upper trim 120 attached to top edges of the rear side of the panel body 111, side trims 130 attached to left and right edges of the rear side of the panel body 111, and a lower trim 140 attached to bottom edges of the rear side of the panel body 111. The upper trim 120 and the lower trim 140 may be formed to be long in the horizontal direction, and the side trims 130 may be formed to be long in the vertical direction.

The upper trim 120, side trims 130, and lower trim 140 may each be attached to the rear side of the panel body 111 through an adhesive 150.

The lower trim 140 may include a lower trim body 141, a lower trim projection 142, and a lower trim groove 143. The lower trim projection 142 may protrude from the lower trim body 141. The lower trim projection 142 may have a shape that extends backwards by a certain distance from the lower trim body 141 and then extends vertically, to define the lower trim groove 143. The lower trim groove 143 may be formed between the lower trim body 141 and the lower trim projection 142.

A lower cap 80 of the door body 40 may include a lower cap body 81, a lower cap projection 82, a lower cap rib 84, and a lower cap installation space 85. The lower cap projection 82 may protrude upwards from the lower cap body 81. The lower cap projection 82 may be formed to be put into the lower trim groove 143 of the lower trim 140.

The lower cap rib 84 may protrude upwards from the lower cap body 81. The lower cap rib 84 may be formed at a certain distance from the lower cap projection 82. The lower cap rib 84 may be provided to guide the lower trim 140 of the decoration panel 110 into an installation position when the decoration panel 110 is installed on the door body 40.

The lower cap installation space 85 may be formed between the lower cap projection 82 and the lower cap rib 84. When the lower cap projection 82 is entering the lower trim groove 143, the lower cap projection 82 may be fully inserted to the lower trim groove 143 while the lower trim projection 142 is rotating in the lower cap installation space 85.

The lower cap 80 may include a handle 83 (see FIG. 4) to be held by the hand to open or close the door 32. The handle 83 may be formed to be sunken from the bottom side of the lower cap 80.

The side trim 130 may include a side trim body 131 and a side trim projection 132. The side trim projection 132 may protrude from the side trim body 131, and may be elastically deformable.

A holder 100 mounted on the door body 40 may include a holder groove 105 and a holder projection 106. The holder groove 105 may be formed for the side trim projection 132 of the side trim 130 to be inserted thereto. The side trim projection 132 may be elastically deformable to be caught by the holder projection 106 when inserted more than a certain depth to the holder groove 105.

The upper trim 120 may include an upper trim body 121, an upper trim projection 122, and an upper trim hole 123. The upper trim projection 122 may protrude from the upper trim body 121. The upper trim hole 123 may be formed at the upper trim projection 122.

An upper cap 70 of the door body 40 may include an upper cap body 71, an insertion groove 72, an upper cap hole 73. The insertion groove 72 may be formed for the upper trim projection 122 of the upper trim 120 to be inserted thereto. When the upper trim projection 122 is inserted to the insertion groove 72, a first fixer 160 may be coupled down to the upper cap hole 73 of the upper cap 70 and the upper trim hole 123 of the upper trim projection 122, enabling the decoration panel 110 to be coupled to the door body 40.

With this structure, a procedure of coupling the decoration panel 110 to the door body 40 will now be described below.

First, the decoration panel 110 is tilted for the lower cap projection 82 to be put into the lower trim groove 163. Next, the decoration panel 110 may be turned to a standing position of the decoration panel 110, the upper trim projection 122 may be inserted to the insertion groove 72 of the upper cap 70 while the lower cap projection 82 is fully inserted to the lower trim groove 163. The first fixer 160 may then be coupled down to the upper cap hole 73 of the upper cap 70 and the upper trim hole 123 of the upper trim projection 122.

With this structure, the decoration panel 110 may be easily coupled to the door body 40, and easily separated from the door body 40 in the reverse order.

The door body 40 may be rotatably coupled to the main body 10. The door body 40 may include a rear case 60 defining the rear surface of the door body 40, a main case 41 defining the front and side surfaces of the door body 40, the upper cap 70 coupled to the top ends of the main case 41 and the rear case 60, and the lower cap 80 coupled to the bottom ends of the main case 41 and the rear case 60.

An internal space may be formed between the main case 41, the rear case 60, the upper cap 70, and the lower cap 80, and insulation 90 may be filled in the internal space.

The main case 41 may include a front part 42 defining the front surface of the door body 40, side parts 50 defining the side surfaces of the door body 40, and a rear coupler 51 coupled to the rear case 60.

An installation groove 48 in which to install the holder 100 may be formed at the front part 42. The installation groove 48 may be formed to have an open front. The installation groove 48 may be formed to be long in the vertical direction at the left and right edges of the front part 42.

The front part 42 may include a base 43 formed to be flat, and a bending portion 44 formed on the left and right sides of the base 43 to form the installation groove 48.

The bending portion 44 may include an inner bending portion 45 forming an inner side of the installation groove 48, a middle bending portion 46 forming a rear side of the installation groove 48, and an outer bending portion 47 forming an outer side of the installation groove 48.

Figure 10:
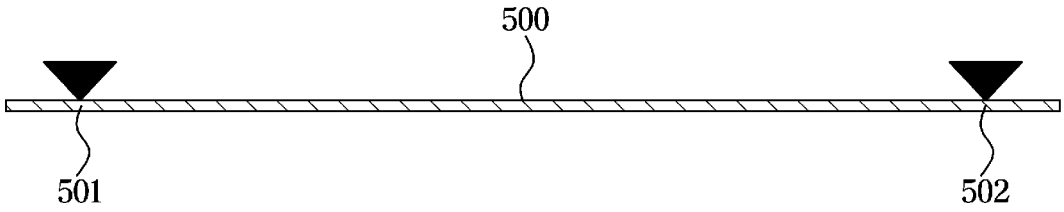
FIG. 10 illustrates a first process of manufacturing a main case of a fridge door of the refrigerator of FIG. 1.

This main case 41 may be formed by a press bending process of a single metal board 500 (see FIG. 10). The single metal board 500 may be formed of an iron plate material. In this way, the main case 41 is integrally formed, making the door body 40 have a simple structure and easily assembled, thereby increasing productivity, lowering defect rates, and saving costs. Furthermore, the door body 40 has less assembled parts, thereby improving resistance to distortion and firmness.

During the press bending of the main case 41, the outer bending portion 47 and the side parts 50 may substantially come into contact with each other through hemming processing. This may prevent a foam fluid from permeating between the outer bending portion 47 and the side parts 50. From a different perspective, the outer bending portion 47 and the side parts 50 may be substantially parallel to each other.

In this way, the outer bending portion 47 and the side parts 50 are formed to be substantially in contact with and parallel to each other, so the installation groove 48 in which to install the holder 100 may be formed as closely as possible to the side edges of the decoration panel 110 and the outer bending portion 47 and the side parts 50 may support each other, thereby securing firmness and giving an enhanced aesthetic sense.

The outer bending portion 47 and the side parts 50 may protrude farther forward than the base 43. Accordingly, when the door 32 is viewed from the side, no gap between the decoration panel 110 and the door body 40 is seen, thereby giving an enhanced aesthetic sense.

The middle bending portion 46 may be formed to be substantially perpendicular to the outer bending portion 47, and the inner bending portion 45 may be formed to be tilted to the middle bending portion 46 and the base 43.

The door 32 includes the holder 100 to be mounted in the installation groove 48 formed at the main case 41 to be coupled to the side trim 130 of the decoration panel 110. The holder 100 may be inserted to the installation groove 48 and fixed to the installation groove 48 by an extra fastening member such as a rivet, a screw, a pin, etc.

The holder 100 may include a case supporter 101 supported on the bending portion 44 that forms the installation groove 48. The case supporter 101 may include an inner supporter 102 supported on the inner bending portion 45, a middle supporter 103 supported on the middle bending portion 46, and an outer supporter 104 supported on the outer bending portion 47.

The holder 100 may include a holder groove 105, to which the side trim projection 132 of the side trim 130 is inserted. The holder 100 may include a holder projection 106 formed to be caught by the side trim projection 132 to prevent the side trim projection 132 from being deviated when inserted to the holder groove 105. The holder projection 106 may protrude from the case supporter 101.

Figure 11:
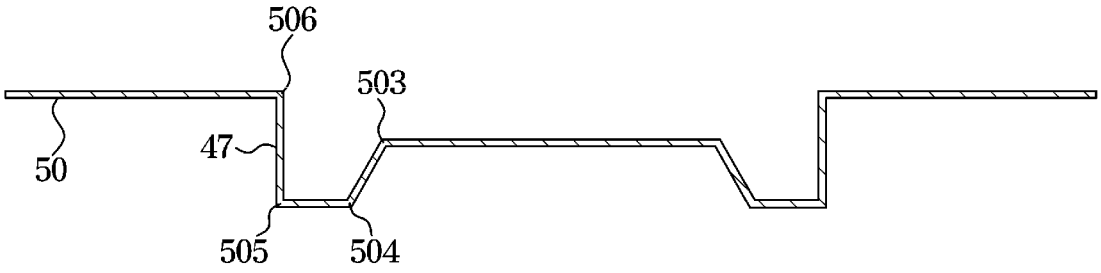
FIG. 11 illustrates a second process of manufacturing a main case of a fridge door of the refrigerator of FIG. 1.
Figure 12:
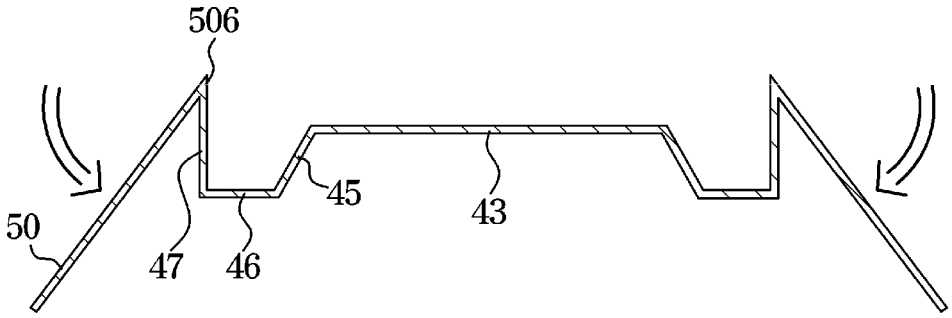
FIG. 12 illustrates a third process of manufacturing a main case of a fridge door of the refrigerator of FIG. 1.
Figure 13:
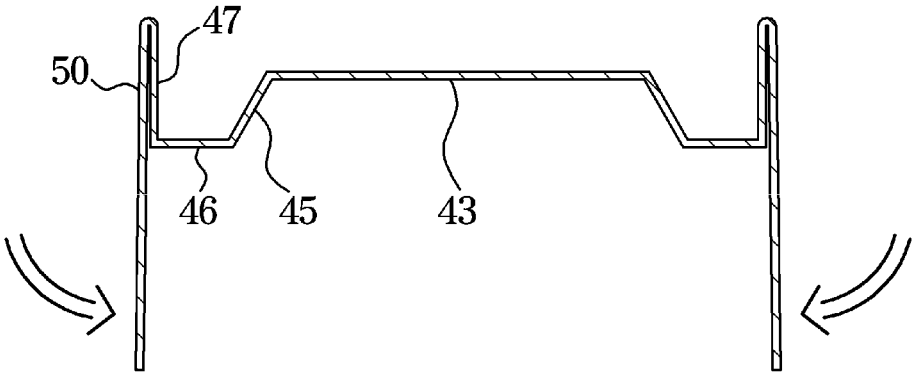
FIG. 13 illustrates a fourth process of manufacturing a main case of a fridge door of the refrigerator of FIG. 1.
Figure 14:
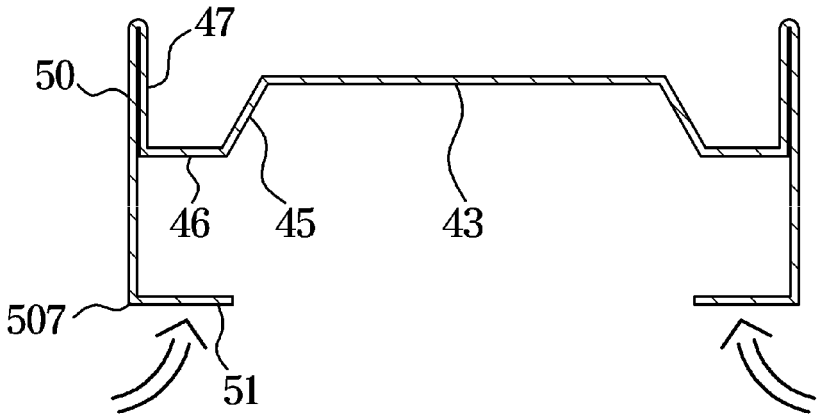
FIG. 14 illustrates a fifth process of manufacturing a main case of a fridge door of the refrigerator of FIG. 1.

FIG. 10 illustrates a first process of manufacturing a main case of a fridge door of the refrigerator of FIG. 1. FIG. 11 illustrates a second process of manufacturing a main case of a fridge door of the refrigerator of FIG. 1. FIG. 12 illustrates a third process of manufacturing a main case of a fridge door of the refrigerator of FIG. 1. FIG. 13 illustrates a fourth process of manufacturing a main case of a fridge door of the refrigerator of FIG. 1. FIG. 14 illustrates a fifth process of manufacturing a main case of a fridge door of the refrigerator of FIG. 1.

Referring to FIGS. 10 to 14, a method of manufacturing the main case 41 according to the disclosure will be briefly described.

The main case 41 may be formed by press-bending the single metal board 500.

A process of manufacturing the main case 41 may include cutting the single metal board 500 along cutting lines 501 and 502 (see FIG. 10).

The process of manufacturing the main case 41 may include a complex U bending process (see FIG. 11). The complex U bending process performs Z bending and L bending to bend the single metal board 500 along bending lines 503, 504, 505, and 506. The side part 50 and the outer bending portion 47 may bend to form about 90 degrees.

The process of manufacturing the main case 41 may include a 50 degree bending process (see FIG. 12). In the 50 degree bending process, the side part 50 and the outer bending portion 47 may bend to form about 50 degrees.

The process of manufacturing the main case 41 may include a hemming process (hemming, swing punches)(see FIG. 13). In the hemming process, the side part 50 and the outer bending portion 47 may bend to be in substantially contact with and parallel to each other.

The process of manufacturing the main case 41 may include a restriking process (restriking, cam bend) (see FIG. 14). In the restriking process, the side part 50 may bend along a bending line 507 to form the rear coupler 51.

Figure 15:
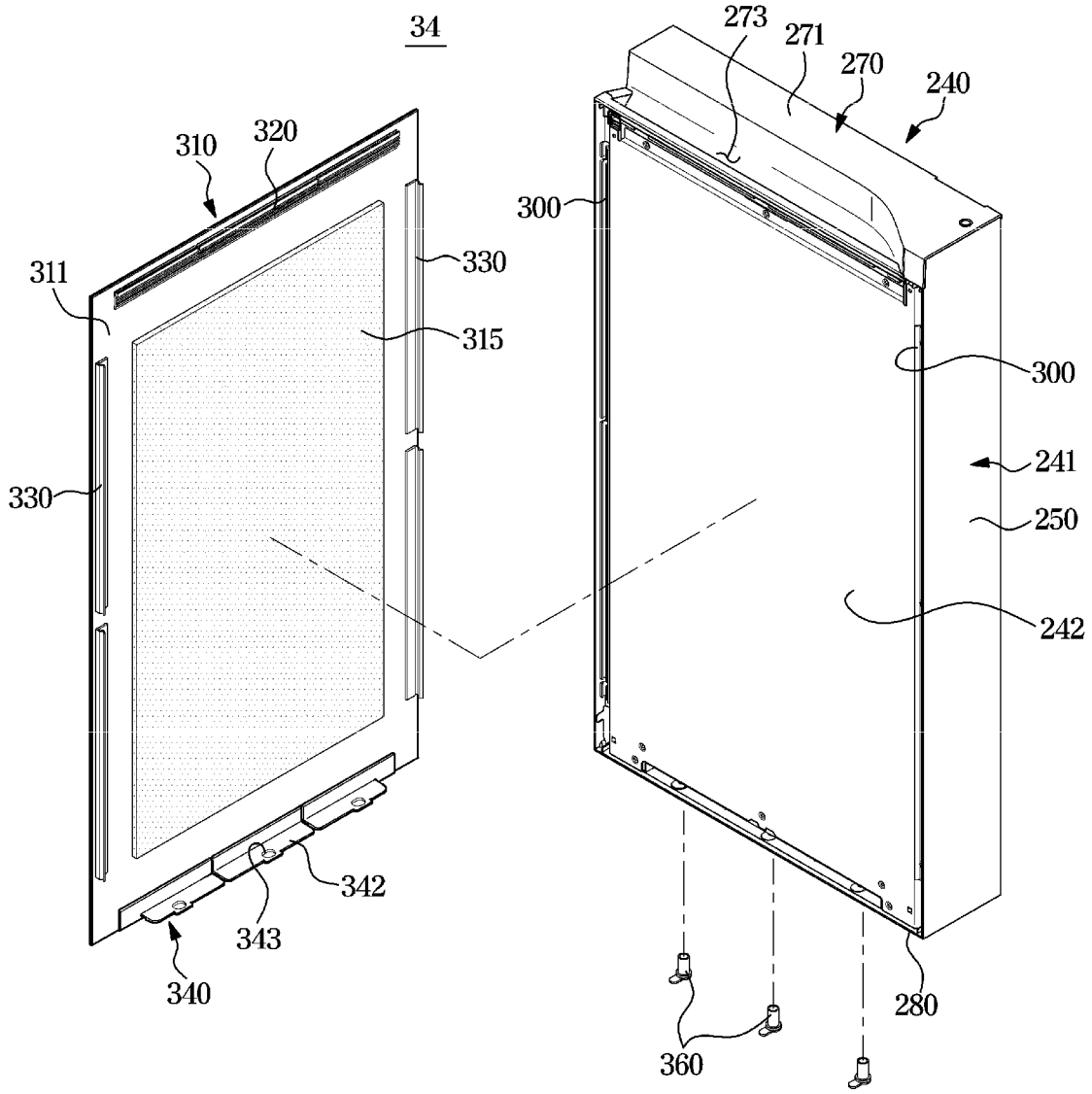
FIG. 15 illustrates a freezer door of the refrigerator of FIG. 1 broken down to a decoration panel and a door body.
Figure 16:
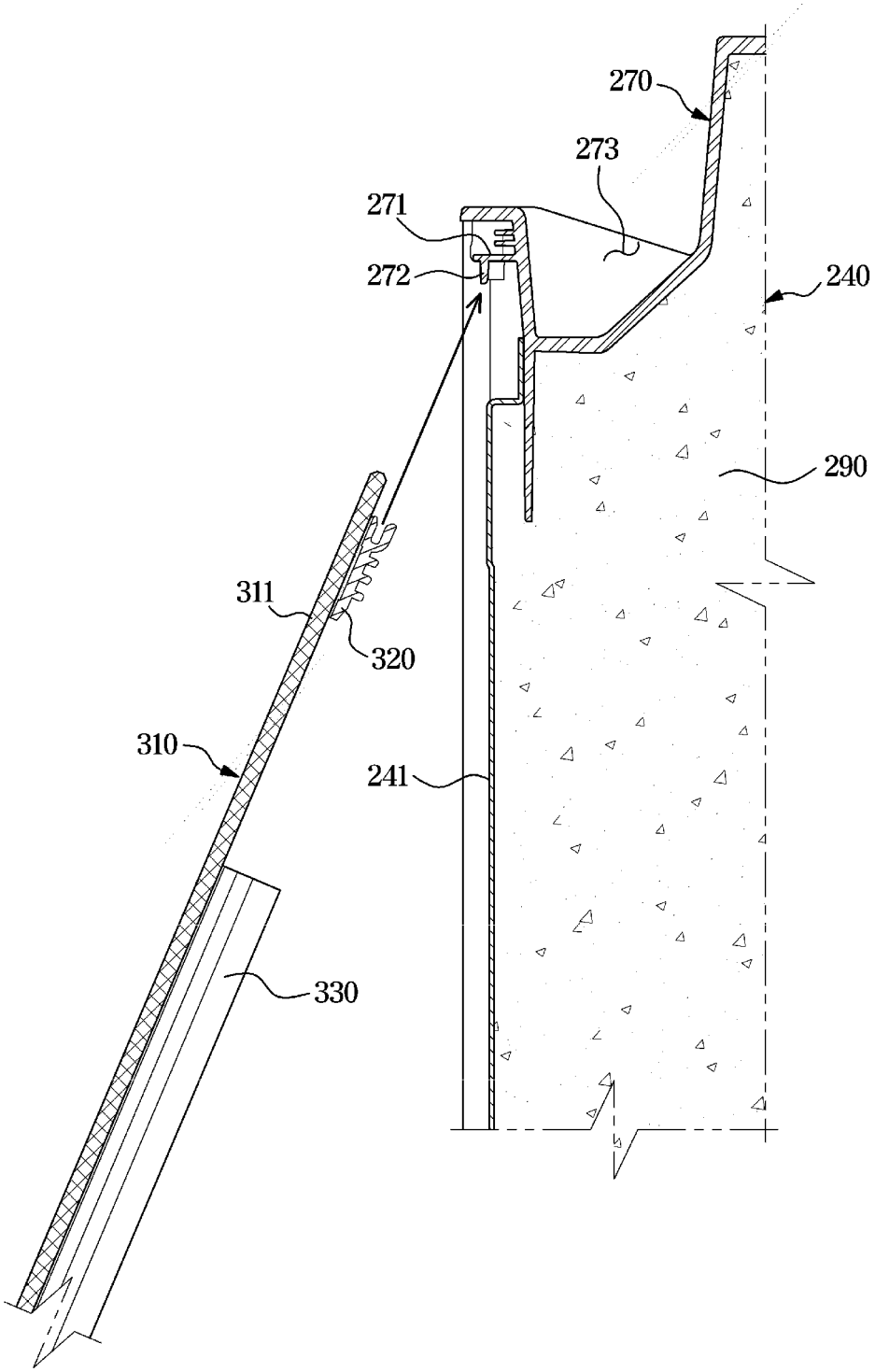
FIG. 16 illustrates an operation of coupling a decoration panel of the freezer door of the refrigerator of FIG. 1 to a door body.
Figure 17:
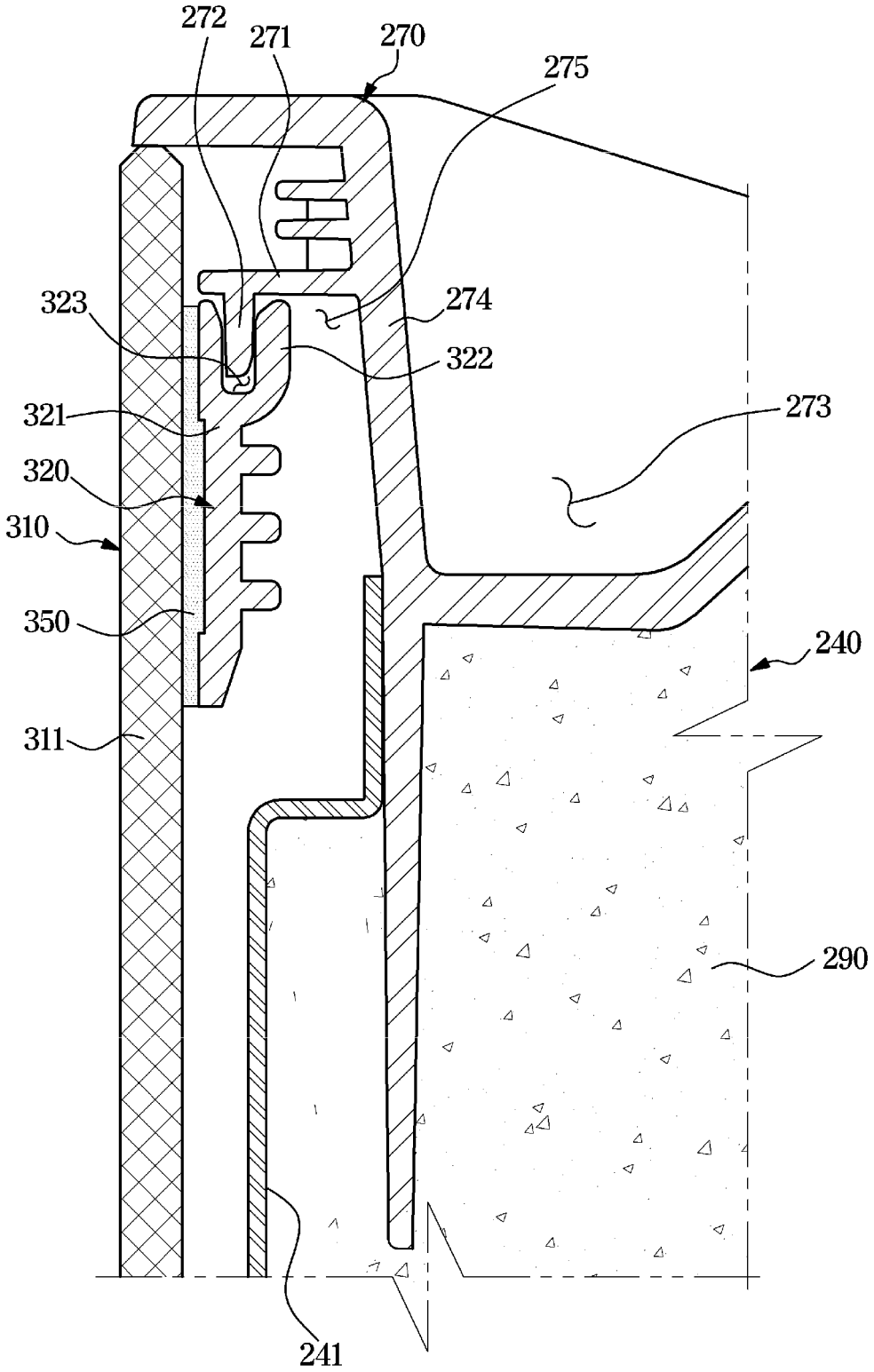
FIG. 17 illustrates a top coupling structure of the freezer door of the refrigerator of FIG. 1.
Figure 18:
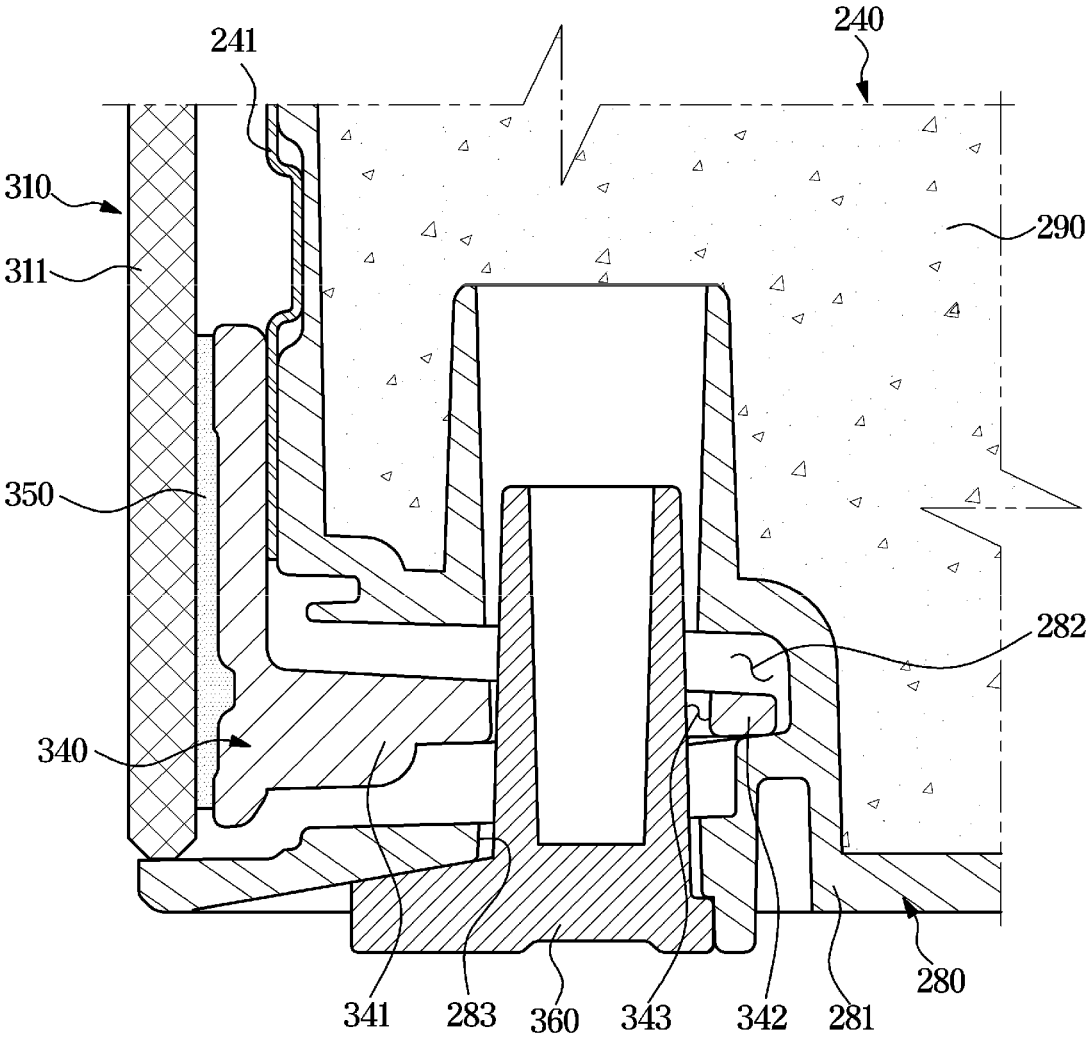
FIG. 18 illustrates a bottom coupling structure of the freezer door of the refrigerator of FIG. 1.

FIG. 15 illustrates a freezer door of the refrigerator of FIG. 1 broken down to a decoration panel and a door body. FIG. 16 illustrates an operation of coupling a decoration panel of the freezer door of the refrigerator of FIG. 1 to a door body. FIG. 17 illustrates a top coupling structure of the freezer door of the refrigerator of FIG. 1. FIG. 18 illustrates a bottom coupling structure of the freezer door of the refrigerator of FIG. 1.

Referring to FIGS. 15 to 18, a structure of the lower doors 33 and 34 to open or close the lower storerooms 22 and 23 will be described. The following description will be focused on a structure of the lower right door 34, which may be equally applied to the lower left door 33, so the description of the lower left door 33 will not be repeated.

The lower door 34 has an upper cap 270, a lower cap 280, an upper trim 320, a lower trim 340, and a second fixer 360, each of which has a different structure as compared to the upper door 32 as described above. Hence, a method of coupling a decoration panel 310 to a door body 240 is also different than the coupling method for the upper right door 32.

The same structures as in the aforementioned upper right door 32 will not be described again.

The lower right door 34 may include a door body 240, and a decoration panel 310 coupled to the front side of the door body 240.

The decoration panel 310 may include a panel body 311, and trims 320, 330, and 340 attached to the rear side of the panel body 311 to be coupled with the door body 240. The decoration panel 310 may include a buffering member 315 attached onto the rear side of the panel body 311 to soften the impact when the decoration panel 310 is coupled to the door body 240.

The trims 320, 330, and 340 may include an upper trim 320 attached to top edges of the rear side of the panel body 311, side trims 330 attached to left and right edges of the rear side of the panel body 311, and a lower trim 340 attached to bottom edges of the rear side of the panel body 311. The upper trim 320 and the lower trim 340 may be formed to be long in the horizontal direction, and the side trims 330 may be formed to be long in the vertical direction.

The upper trim 320, side trims 330, and lower trim 340 may each be attached to the rear side of the panel body 311 through an adhesive 350.

The upper trim 320 may include a upper trim body 321, a upper trim projection 322, and a upper trim groove 323.

The upper trim projection 322 may protrude from the upper trim body 321. The upper trim projection 322 may have a shape that extends backwards by a certain distance from the upper trim body 321 and then extends almost vertically, to define the upper trim groove 323. The upper trim groove 323 may be formed between the upper trim body 321 and the upper trim projection 322.

The upper cap 270 of the door body 240 may include an upper cap body 271, an upper cap projection 272, an upper cap rib 274, and an upper cap installation space 275. The upper cap projection 272 may protrude downwards from the upper cap projection 272. The upper cap projection 272 may be formed to be put into the upper trim groove 323 of the upper trim 320.

The upper cap rib 274 may protrude downwards from the upper cap body 271. The upper cap rib 274 may be formed at a certain distance from the upper cap projection 272. The upper cap rib 274 may be provided to guide the upper trim 320 of the decoration panel 310 into an installation position when the decoration panel 310 is installed on the door body 240.

The upper cap 270 may include a handle 273 (see FIG. 15) to be held by the hand to open or close the lower right door 34. The handle 273 may be formed to be sunken from the top side of the upper cap 270.

The upper cap installation space 275 may be formed between the upper cap projection 272 and the upper cap rib 274. When the upper cap projection 272 is entering the upper trim groove 323, the upper cap projection 272 may be fully inserted to the upper trim groove 323 while the upper trim projection 322 is rotating in the upper cap installation space 275.

The lower trim 340 may include a lower trim body 341, lower trim projection 342, and a lower trim hole 343. The lower trim projection 342 may protrude from the lower trim body 341. The lower trim hole 343 may be formed at the lower trim projection 342.

The lower cap 280 of the door body 240 may include a lower cap body 281, an insertion groove 282, a lower cap hole 283. The insertion groove 282 may be formed for the lower trim projection 342 of the lower trim 340 to be inserted thereto. When the lower trim projection 342 is inserted to the insertion groove 282, a second fixer 360 may be coupled up to the lower cap hole 283 of the lower cap 280 and the lower trim hole 343 of the lower trim projection 342, enabling the decoration panel 310 coupled to the door body 240.

With this structure, a procedure of coupling the decoration panel 310 to the door body 240 will now be described below.

First, the decoration panel 310 may be tilted for the upper cap projection 272 to be put into the upper trim groove 323. Next, when the decoration panel 310 is turned to a standing position of the decoration panel 310, the lower trim projection 342 may be inserted to the insertion groove 282 of the lower cap 280 while the upper cap projection 272 is fully inserted to the upper trim groove 323. The second fixer 360 may then be coupled up to the lower cap hole 283 of the lower cap 280 and the lower trim hole 343 of the lower trim projection 342.

In this way, while the upper doors 31 and 32 have the handle 83 formed at the bottom ends as shown in FIG. 4, the lower doors 33 and 34 may have a handle 273 formed at the top ends.

Furthermore, while the first fixer 160 for fixing the door body 40 to the decoration panel 110 is coupled to the top ends of the upper doors 31 and 32 as shown in FIG. 3, the second fixer 360 for fixing the door body 240 to the decoration panel 310 may be coupled to the bottom ends of the lower doors 33 and 34 as shown in FIG. 15. Hence, the first fixer 160 and the second fixer 360 may be prevented from being exposed to the user, thereby giving an enhanced aesthetic sense.

Figure 19:
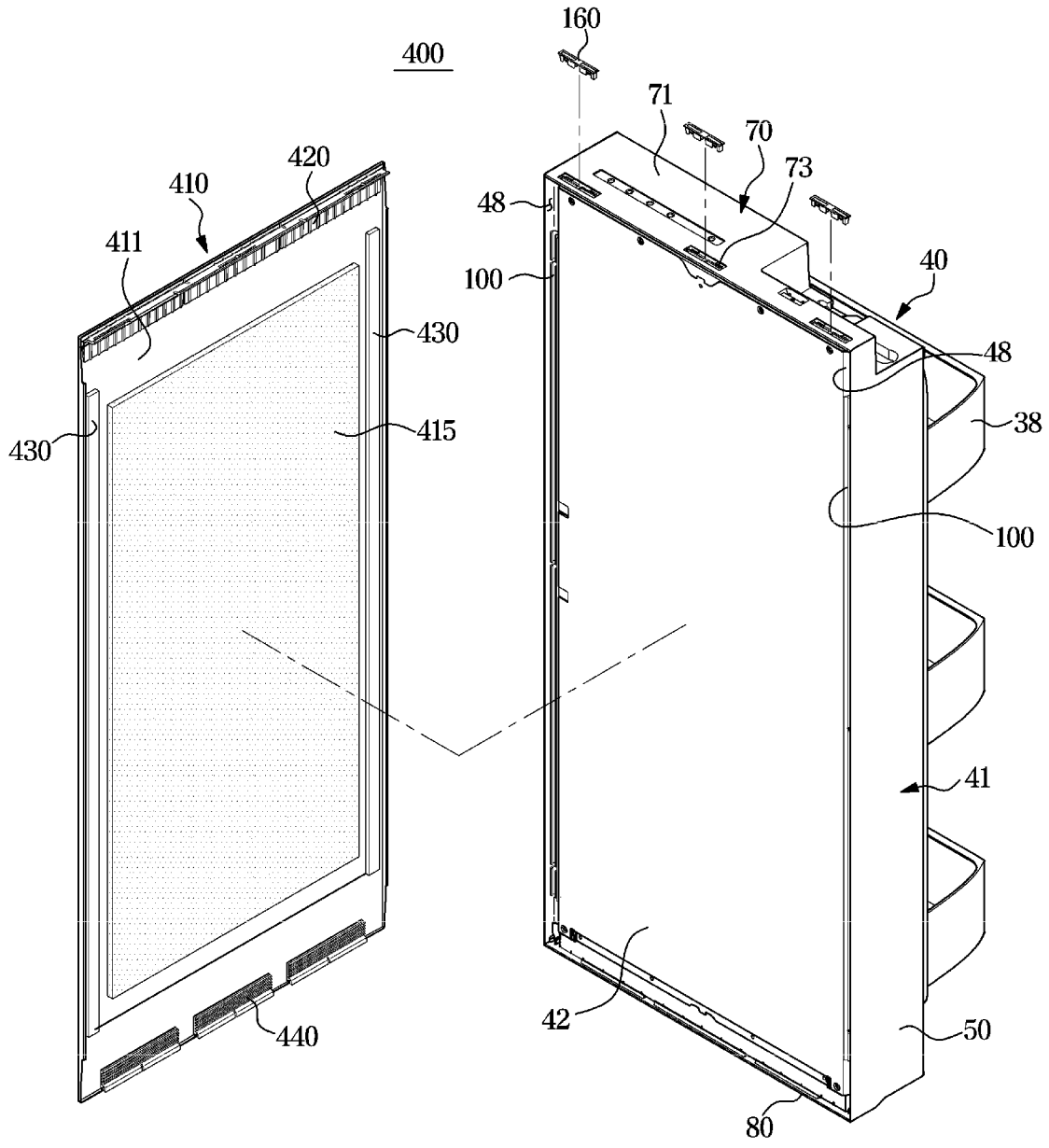
FIG. 19 illustrates a door of a refrigerator, according to another embodiment of the disclosure.
Figure 20:
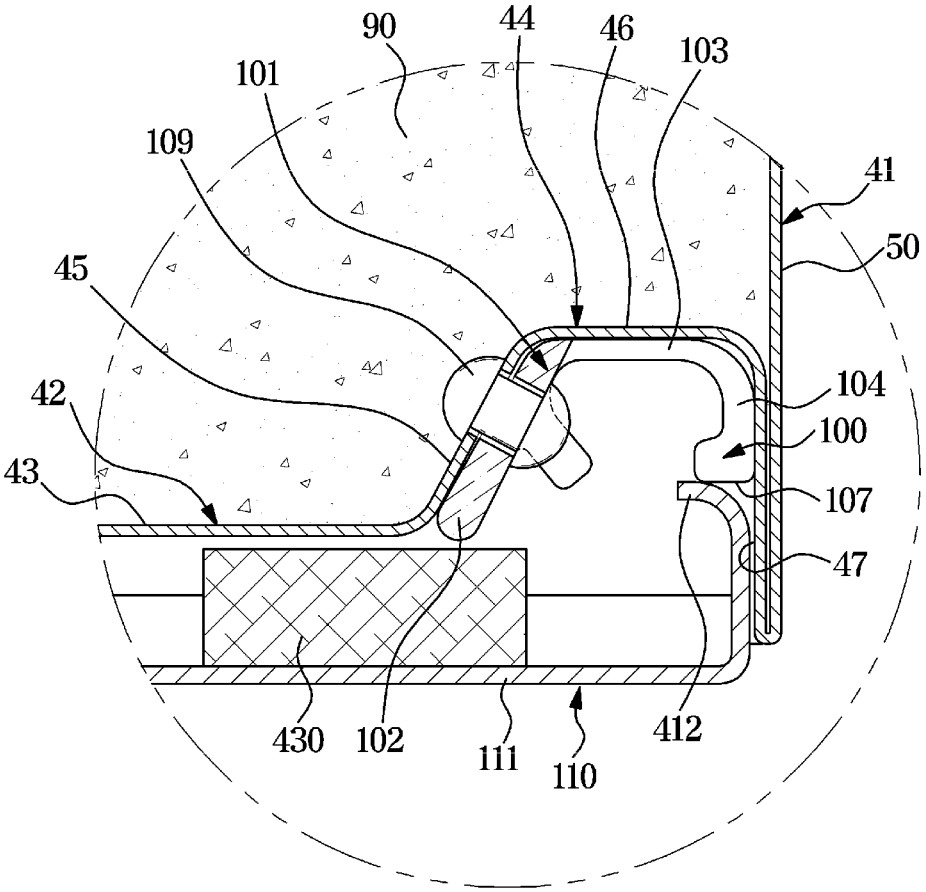
FIG. 20 illustrates a cross-sectional view of the door of the refrigerator of FIG. 19.

FIG. 19 illustrates a door of a refrigerator, according to another embodiment of the disclosure. FIG. 20 illustrates a cross-sectional view of the door of the refrigerator of FIG. 19.

Referring to FIGS. 19 and 20, a refrigerator in accordance with another embodiment of the disclosure will now be described. The same features as in the aforementioned embodiment are denoted by the same reference numerals, and the overlapping description will not be repeated. Although FIGS. 19 and 20 shows an upper door to open or close an upper storeroom, the disclosure is not limited thereto and the structure of the upper door may be equally applied to a lower door to open or close a lower storeroom.

In contrast to the decoration panel including a glass or resin panel body in the previous embodiment of the disclosure, a panel body 411 of a decoration panel 410 may be formed of an iron plate material in this embodiment of the disclosure.

The door 400 may include the door body 40, and the decoration panel 410 coupled to the front side of the door body 40.

The decoration panel 410 may include a panel body 411, trims 420 and 440 attached to the rear side of the panel body 411 and a magnet 430 to be coupled with the door body 40.

The panel body 411 may be formed of an iron plate material. Left and right ends 412 of the panel body 411 may be rounded to bend inwards.

The magnet 430 may be provided instead of the side trims 130 or 330 in the previous embodiment of the disclosure, to magnetically attract the main case 41 of the door body 40 when the decoration panel 410 is coupled to the door body 40 to prevent them from being separated. The main case 41 may be formed of an iron plate material to be drawn to the magnet 430.

The holder 100 may include a panel supporter 107 formed to support the left and right ends 412 of the panel body 411. As the holder 100 supports the left and right ends 412 of the panel body 411 and the main case 41 tightly contacts the decoration panel 410 according to magnetic force of the magnet 430, the decoration panel 410 and the door body 40 may be coupled stably.

In this case that the panel body 411 of the decoration panel 410 is formed of a material such as an iron plate that is thin and easily deformable, e.g., swollen, the magnet 430 is applied instead of the side trim 130 or 330 to prevent deformation of the panel body 411.

The disclosure is not exclusively applied to the aforementioned refrigerator and the door, but may also be applied to any electronic device having a main body with a cavity and a door to open or close the cavity and the door. For example, the disclosure may also be applied to a cooking apparatus having a cooking chamber, a dish washer having a washing chamber, a garment processing machine having a garment processing chamber, a wine cellar having a chamber, an air conditioner, etc.

According to embodiments of the disclosure, a decoration panel on a door of a refrigerator is readily attached to or separated from a door body, making it easy to change a design of the door in a way of replacing the decoration panel.

According to embodiments of the disclosure, a front part defining the front side of the door body and side parts forming the sides of the door body may be integrally formed, thereby increasing productivity, lowering defect rates, and saving costs.

According to embodiments of the disclosure, the refrigerator may have the door that gives an enhanced aesthetic sense and has firmness and durability.

Several embodiments of the disclosure have been described above, but a person of ordinary skill in the art will understand and appreciate that various modifications can be made without departing the scope of the disclosure. Thus, it will be apparent to those ordinary skilled in the art that the true scope of technical protection is only defined by the following claims.

What is claimed is:

1. A refrigerator comprising:

a main body including a first storeroom and a second storeroom formed under the first storeroom;

a first door arranged to open or close the first storeroom and including:

a first door body having a first upper cap and a first lower cap, a first panel detachably coupled to a front side of the first door body and having an upper trim at an upper portion of the first panel, and a first fixer, and a second door arranged to open or close the second storeroom and including:

a second door body having a second upper cap and a second lower cap, a second panel detachably coupled to a front side of the second door body and having a lower trim at a lower portion of the second panel, and a second fixer, and wherein a lower portion of the first panel is coupled to the first lower cap, the first fixer is inserted into the upper trim of the first panel downward through the first upper cap, an upper portion of the second panel is coupled to the second upper cap, and the second fixer is inserted into the lower trim of the second panel upward through the second lower cap.

2. The refrigerator of claim 1, wherein a handle is formed on each of a bottom side of the first door body and a top side of the second door body.

3. The refrigerator of claim 1, wherein the first panel comprises a first panel body, and the upper trim of the first panel is arranged at top edge of a rear side of the first panel body.

4. The refrigerator of claim 1, wherein the second panel comprises a second panel body, and the lower trim of the second panel is arranged at bottom edge of a rear side of the second panel body.

5. The refrigerator of claim 1, wherein the first lower cap includes a handle and the first upper cap includes an upper cap hole through which the first fixer passes.

6. The refrigerator of claim 1, wherein the second upper cap includes a handle and the second lower cap includes a lower cap hole through which the second fixer passes.

* * * * *